US008088543B2

(12) United States Patent
Akiyama et al.

(10) Patent No.: US 8,088,543 B2
(45) Date of Patent: Jan. 3, 2012

(54) ELECTROPHOTOGRAPHIC PHOTOSENSITIVE MEMBER AND ELECTROPHOTOGRAPHIC APPARATUS

(75) Inventors: Kazuyoshi Akiyama, Mishima (JP); Hironori Owaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 12/349,309

(22) Filed: Jan. 6, 2009

(65) Prior Publication Data

US 2009/0175654 A1 Jul. 9, 2009

(30) Foreign Application Priority Data

Jan. 7, 2008 (JP) ..... 2008-000456
Dec. 9, 2008 (JP) ..... 2008-313399

(51) Int. Cl.
*G03G 15/00* (2006.01)

(52) U.S. Cl. ..... 430/66; 430/60; 430/69; 399/159

(58) Field of Classification Search ..... 430/57.1, 430/57.7, 59.1, 60, 66, 69; 399/159
See application file for complete search history.

(56) References Cited

U.S. PATENT DOCUMENTS 7,157,197 B2 * 1/2007 Aoki et al. ..... 430/66
7,255,969 B2 * 8/2007 Kojima et al. ..... 430/57.4
2006/0194132 A1 * 8/2006 Hosoi et al. ..... 430/56
2008/0075504 A1 * 3/2008 Yagi ..... 399/159

FOREIGN PATENT DOCUMENTS

JP H04-264467 A 9/1992
JP 2006-133522 A 5/2006

* cited by examiner

*Primary Examiner* — Mark F Huff
*Assistant Examiner* — Stewart Fraser
(74) *Attorney, Agent, or Firm* — Canon U.S.A., Inc., IP Division

(57) ABSTRACT

An electrophotographic photosensitive member has a conductive substrate, a photoconductive layer formed on the conductive substrate, and a surface layer formed on the photoconductive layer. The photoconductive layer is formed of an amorphous material having chiefly silicon atoms. The surface layer has aluminum atoms, nitrogen atoms and oxygen atoms, where the nitrogen atoms are in a content of from 80 atom % or more to 95 atom % or less, and the oxygen atoms are in a content of from 1 atom % or more to 30 atom % or less, based on the aluminum atoms in the surface layer.

9 Claims, 6 Drawing Sheets

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention generally relates to an electrophotographic photosensitive member (e.g., a photosensitive member for electrophotography), and an electrophotographic apparatus.

2. Description of the Related Art

Photosensitive members having a non-single-crystal deposited film that primarily comprises silicon atoms (e.g., an amorphous silicon deposited film including some hydrogen atoms and/or halogen atoms) have been proposed as photosensitive members for electrophotography that are high-performance, highly durable and free of any environmental pollution, and have also been put into practical use.

For the electrophotographic photosensitive members having such an amorphous silicon deposited film, a variety of different kinds of layers have been proposed in accordance with what has been demanded for various performances. Among such various kinds of layers, a surface layer has been recognized as an important layer for achieving various properties such as scratch resistance, light transmission properties and moisture resistance of electrophotographic photosensitive members.

In recent years, as electrophotographic apparatus such as copying machines have become more high-definition, image exposure light of shorter-wavelength has been used. As the image exposure light used is made to be shorter in wavelength, the surface layer of the electrophotographic photosensitive member has also come to require a band gap that is broad enough to transmit short-wavelength light with less absorption.

As a surface layer adaptable to such short-wavelength image exposure light, Japanese Patent Laid-open Application No. 2006-133522 discloses a surface layer formed using an amorphous material composed chiefly of silicon atoms and nitrogen atoms and further containing oxygen atoms and carbon atoms. The surface layer disclosed in this Japanese Patent Laid-open Application No. 2006-133522 has almost no absorption of short-wavelength light of around 380 to 500 nm and has much higher moisture resistance, as noted in Japanese Patent Laid-open Application No. 2006-133522.

Japanese Patent Laid-open Application No. H04-264467 also discloses, as an idea of improving the moisture resistance, a technique in which an electrophotographic photosensitive member is provided with a heater in its interior and the surface of the electrophotographic photosensitive member is heated with the heater at the time of image formation so as to prevent any moisture from being adsorbed to the surface of the electrophotographic photosensitive member, to keep smeared images from occurring.

In recent years, as full-color electrophotographic apparatus become more popular, there has been increasing demand for forming images with higher definition. In particular, image quality equivalent to that of silver salt photography has been increasingly demanded in electrophotography.

The issue of smeared images in a high-humidity environment is considered to be one of the important factors that cause deterioration in the image quality in electrophotography.

The mechanism by which smeared images may occur is also explained in the above Japanese Patent Laid-open Application No. H04-264467. In recent years, it has been pointed out that the smeared images also correlate with the internal binding force of materials used for the surface layer, and defects or imperfections present in the surface layer.

The smeared images may result in damage to dot reproducibility, even if they have occurred at a level where images reproduced are of almost no problem in the usual reproduction of letters or characters. In such a case, gradation tends to be damaged in forming halftone images. This may have a great influence especially in an electrophotographic apparatus in which the image exposure light has been made short-wavelength, where full-color images may become non-uniform in color at their halftone areas. In particular, immediately after the electrophotographic apparatus has been set working, its internal temperature may become unstable, and the smeared images may tend to occur.

In order to keep the smeared images from occurring, in an electrophotographic apparatus which may be used in a high-temperature and high-humidity environment, it has become prevalent to make a heater operate at a low electric power to keep the surface of the electrophotographic photosensitive member preheated.

However, in recent years, with increasing requirements for reduced power consumption, it is becoming more difficult to employ such a heater.

The electrophotographic photosensitive member disclosed in Japanese Patent Laid-open Application No. 2006-133522 is also used in such a service environment, where the heater is switched off and then it is switched on at the same time when the electrophotographic apparatus is set working, and where, under the existing conditions, color non-uniformity due to the smeared images may occur in images reproduced immediately after it has been set working.

As discussed above, there remains a need for an electrophotographic photosensitive member for use in high-definition electrophotographic apparatus in which the image exposure light with short-wavelength light of around 380 to 500 nm is used, with improved performance in the reduction of smeared images (i.e., such that smeared images do not easily occur).

SUMMARY OF THE INVENTION

In one embodiment according to the present invention, an electrophotographic photosensitive member is provided that has a conductive substrate, a photoconductive layer formed on the substrate, and a surface layer formed on the photoconductive layer. The photoconductive layer is formed of an amorphous material having chiefly of silicon atoms. The surface layer has aluminum atoms, nitrogen atoms and oxygen atoms, where the nitrogen atoms are in a content of from 80 atom % or more to 95 atom % or less, and the oxygen atoms are in a content of from 1 atom % or more to 30 atom % or less, based on the aluminum atoms in the surface layer.

In another embodiment according to the present invention, an electrophotographic apparatus is provided that has the above electrophotographic photosensitive member, as well as a charging unit, an image exposure unit and a developing unit.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

In one embodiment, the electrophotographic photosensitive member of the present invention is an electrophotographic photosensitive member having a conductive substrate, a photoconductive layer formed on the substrate, and a surface layer formed on the photoconductive layer, and is characterized in that the photoconductive layer is a layer formed of an amorphous material that comprises chiefly (i.e. primarily) silicon atoms; and the surface layer comprises aluminum atoms, nitrogen atoms and oxygen atoms, where the nitrogen atoms are in a content of from 80 atom % (atomic percent) or more to 95 atom % or less based on the aluminum atoms in the surface layer (i.e., relative to the number of aluminum atoms in the surface layer), and the oxygen atoms are in a content of from 1 atom % or more to 30 atom % or less based on the aluminum atoms in the surface layer (i.e., relative to the number of aluminum atoms in the surface layer). The amorphous material comprising chiefly silicon atoms is also herein termed "a-Si" (i.e., amorphous silicon).

In one version, the surface layer substantially does not contain (e.g., does not contain) any hydrogen atoms nor any halogen atoms. Here, the wording that the surface layer substantially does not contain any hydrogen atoms nor any halogen atoms means that the surface layer is formed without any intentional use of these atoms, such as without intentional incorporation of these atoms into the surface layer.

In yet another version, an intermediate layer formed of an amorphous material comprising chiefly (i.e. primarily) silicon atoms and nitrogen atoms, or an intermediate layer formed of an amorphous material comprising chiefly (i.e. primarily) silicon atoms and carbon atoms, may be provided between the photoconductive layer and the surface layer. The amorphous material comprising chiefly silicon atoms and nitrogen atoms is herein also termed as "a-SiN" (i.e., amorphous silicon nitride). The amorphous material composed chiefly of silicon atoms and carbon atoms is herein also termed as "a-SiC" (i.e., amorphous silicon carbide).

In the case when the intermediate layer is formed of the a-SiN, the nitrogen atoms may be in a content set within the range of from 10 atom % or more to 55 atom % or less based on the silicon atoms (i.e., relative to the number of silicon atoms).

In the case when the intermediate layer is formed of the a-SiC, the carbon atoms may be in a content set within the range of from 10 atom % or more to 100 atom % or less based on the silicon atoms (i.e., relative to the number of silicon atoms).

The make-up of an embodiment of an electrophotographic photosensitive member according to the present invention is described below in detail with reference to the drawings.

Figure 1:
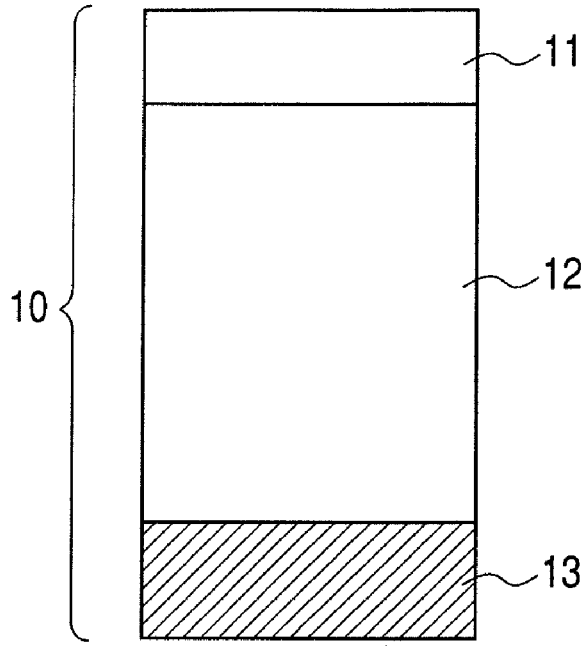
FIG. 1 is a diagrammatic view showing an example of a layer make-up of the electrophotographic photosensitive member of the present invention.

FIG. 1 is a diagrammatic view showing an example of a layer make-up of the electrophotographic photosensitive member of the present invention. The embodiment of the electrophotographic photosensitive member 10 shown in FIG. 1 has a cylindrical and conductive substrate 13 formed of aluminum or the like, a photoconductive layer 12 formed on the substrate 13, and a surface layer 11 formed on the photoconductive layer 12.

Embodiments of the substrate 13, the photoconductive layer 12, and the surface layer 11, are made up as described below.

Surface Layer:

In one embodiment in accordance with the present invention, the surface layer 11 chiefly comprises aluminum (Al) atoms, nitrogen (N) atoms and oxygen (O) atoms (hereinafter referred to as "AlNO", with the understanding that this term does not necessarily represent the compositional ratio of these atoms). The nitrogen atoms, upon combining with the aluminum atoms, may be effective in that they may provide a surface layer material having a broad band gap. To provide a surface layer having a suitable light transmittance, the content of nitrogen atoms (hereinafter also "N-content") may be 80 atom % or more based on the aluminum atoms in the surface layer (i.e., relative to the number of aluminum atoms in the surface layer). If the N-content is less than 80 atom %, the band gap may become extremely narrow, and this may, for example when short-wavelength (e.g., from 380 nm to 500 nm in wavelength) image exposure light is used, make it more difficult to achieve light transmittance that provides a sufficient photosensitivity by the use of the amorphous material forming the photoconductive layer.

On the other hand, with an increase in the N-content, the surface layer may show a tendency to have a lower hardness. If the surface layer has too low hardness, the surface of the electrophotographic photosensitive member may tend to become scratched or otherwise damaged, resulting in a lowering of durability of the electrophotographic photosensitive member. Such a tendency may become marked when the N-content is more than 95 atom %, and hence, according to aspects of the present invention, the N-content may be 95 atom % or less.

In aluminum nitride (AlN), the content of nitrogen atoms is typically 100 atom % based on the aluminum atoms (i.e., relative to the number of aluminum atoms). Without being limited by any particular theory, according to an aspect of the present invention, the fact that a suitable and even optimum value is obtained when the content of nitrogen atoms is within the range of 95 atom % or less based on the aluminum atoms, is believed to be due to an effect brought on by the fact that the oxygen atoms are also contained therein.

In one embodiment of the present invention, the effect brought on by the oxygen atoms is believed to impart the effect of reducing and even preventing smeared images. Without being limited to any particular theory, this is believed to be due to the fact that, in the course of the formation of a deposited film making up the surface layer, the oxygen atoms, which readily combine with aluminum atoms upon their selective substitution for the nitrogen atoms, may effectively compensate for any defects or imperfections in the surface layer that is to be formed by combination of the aluminum atoms with the nitrogen atoms.

In one embodiment, it is believed that by making the surface layer contain the oxygen atoms, the surface layer is made more chemically stable, such that the surface of the electrophotographic photosensitive member does not deteriorate as easily, and this is believed to effectively reduce and even prevent the occurrence of smeared images.

In one embodiment, such an effect may be sufficiently obtainable even by oxygen atoms present in a relatively small content. Thus, this effect can be achieved with a content of oxygen atoms (hereinafter also "O-content") that is 1 atom % or more based on the aluminum atoms (i.e., relative to the number of aluminum atoms). On the other hand, if the O-content is more than 30 atom %, there may conversely be a tendency for smeared images to occur.

Without being limited to any particular theory herein, this is believed to be due to the fact that, against the AlN, aluminum oxide (AlO) itself may show a tendency to cause smeared images. That is, it is believed that, if the O-content is more than 30 atom %, the presence of excessive amounts of AlO may tend to cause smeared images to appear.

In one version, the above AlNO substantially does not contain (e.g., does not contain) any hydrogen (H) atoms nor any halogen (X) atoms.

Similarly to the description provided above, the hydrogen (H) atoms or the halogen (X) atoms are believed to have, when contained in the surface layer, the effect of at least partially compensating for defects or imperfections in the deposited film.

However, without being limited to any particular theory, it is believed that the hydrogen atoms or the halogen atoms combine with the aluminum atoms at so weak a force such that, when images are repeatedly formed over a long period of time, the combination may become broken apart, chiefly because of the influence of a charging step. As the result, during service over a long period of time, there may gradually be a tendency for the smeared images to occur.

Accordingly, in order to reduce or prevent the smeared images, both the content of hydrogen atoms (hereinafter also "H-content") based on the aluminum atoms (i.e., relative to the number of aluminum atoms) and the content of halogen atoms (hereinafter also "X-content") based on the aluminum atoms (i.e., relative to the number of aluminum atoms) may be reduced, and may even both be substantially zero (i.e., the surface layer may not contain either of these atoms).

In one version, the surface layer 11 may have a thickness of 0.1 μm or more to provide surface protection, which thickness may be determined by taking account of, for example, mechanical properties and electrical properties of electrophotography. For example, the surface layer 11 may have a thickness of 3 μm or less to keep residual potential from excessively increasing.

In one embodiment, the surface layer of the electrophotographic photosensitive member of the present invention is, as described above, characterized by being formed of AlNO. A method for forming such a surface layer can comprise deposited film forming methods, such as for example any one or more of a plasma-assisted CVD (chemical vapor deposition) process, a vacuum deposition process and a sputtering process. For example, the method for forming the surface layer may be a sputtering process. In one version, the sputtering process may comprise a reactive sputtering process in which nitrogen gas ($N_2$) and oxygen gas ($O_2$) are fed in, while setting aluminum atoms as a target, which process allows for, e.g., the compositional ratio to be relatively simply controlled. Such a reactive sputtering process may also be capable of forming a surface layer that contains neither hydrogen atoms nor halogen atoms.

Photoconductive Layer:

In one embodiment in accordance with the present invention, the photoconductive layer 12 of the electrophotographic photosensitive member of the present invention is, as mentioned above, formed of an amorphous material comprising chiefly silicon (Si) atoms (e.g., a-Si).

The a-Si material may be capable of providing excellent hardness and stability, and hence its formation in combination with the above surface layer 11 can provide an electrophotographic photosensitive member having improved and even excellent durability.

In one version of the present invention, in order to compensate for unbonded arms present in the a-Si, halogen atoms may be incorporated in the photoconductive layer 12 in addition to hydrogen atoms. The photoconductive layer 12 is protected by the surface layer 11, and hence, even when such atoms are incorporated in the photoconductive layer 12, the stability of the electrophotographic photosensitive member may not be reduced.

In one version, the content of the hydrogen atoms and halogen atoms in the photoconductive layer 12 may be 10 atom % or more in total, such as 15 atom % or more in total, based on the sum of the silicon atoms, hydrogen atoms and halogen atoms (i.e., relative to the total number of silicon, hydrogen and halogen atoms). The content of the hydrogen atoms and halogen atoms in the photoconductive layer may also be 30 atom % or less in total, such as 25 atom % or less in total, based on the sum of the silicon atoms, hydrogen atoms and halogen atoms.

In another version, the content of the silicon atoms in the photoconductive layer may be from 60 atom % or more to 90 atom % or less, such as from 65 atom % or more to 85 atom % or less, based on the sum of all of the atoms in the photoconductive layer (i.e., relative to the total number of atoms in the photoconductive layer).

In yet another version, the photoconductive layer 12 may comprise atoms incorporated therein for controlling conductivity. The atoms for controlling conductivity may be substantially, and even entirely, evenly and uniformly distributed in the photoconductive layer 12, or may be at least partly non-uniformly distributed in the direction of the layer thickness of the photoconductive layer 12.

In one version, the atoms for controlling conductivity may include what may be called impurities, as used in the field of semiconductors. For example, the atoms for controlling conductivity may be at least one of atoms belonging to Group 13 of the periodic table (hereinafter also "Group 13 atoms", which provide p-type conductivity, and atoms belonging to Group 15 of the periodic table (hereinafter also "Group 15 atoms", which provide n-type conductivity.

Examples of the Group 13 atoms may include one or more of a boron (B) atom, an aluminum (Al) atom, a gallium (Ga) atom, an indium (In) atom and a thallium (Tl) atom. In one version, the Group 13 atoms include at least one of a boron atom, an aluminum atom and a gallium atom.

Examples of the Group 15 atoms may include one or more of a phosphorus (P) atom, an arsenic (As) atom, an antimony (Sb) atom and a bismuth (Bi) atom. In one version, the Group 15 atoms include at least one of a phosphorus atom and an arsenic atom.

In one version, the atoms for controlling conductivity in the photoconductive layer 12 may be in a content of $1\times10^{-2}$ atomic ppm or more, such as $5\times10^{-2}$ atomic ppm or more, and even $1\times10^{-1}$ atomic ppm or more, based on the silicon atoms (i.e., relative to the number of silicon atoms). The atoms for controlling conductivity may on the other hand be in a content of $1\times10^{4}$ atomic ppm or less, such as $5\times10^{3}$ atomic ppm or less, and even $1\times10^{3}$ atomic ppm or less, based on the silicon atoms.

According to one embodiment, the photoconductive layer 12 may have a thickness of 15 μm or more, such as 20 μm or more, to control the rate of electric current passing through a charging member to reduce the deterioration thereof, which thickness may be determined, for example, by taking into account the electrophotographic performance to be achieved as well as economic advantages. The photoconductive layer 12 may on the other hand have a thickness of 60 μm or less, such as 50 μm or less, and even 40 μm or less, to control the size of a site which may be abnormally grown in the photoconductive layer. In one version, if the abnormally grown site in a-Si has a size of 50 to 150 μm in the horizontal direction and 5 to 20 μm in the height direction, it may cause significant damage to members that rub the surface of the electrophotographic photosensitive member, or may cause image defects in images reproduced.

According to embodiments of the invention, the photoconductive layer 12 may be made up of a single layer, or may be made up of a plurality of layers, such as layers separated into a carrier generation layer and a carrier transport layer.

The method for forming the photoconductive layer 12 using a-Si can comprise a deposited film forming method, such as any one or more of a plasma-assisted CVD process, a vacuum deposition process, a sputtering process and an ion plating process. In one version, the method may be a plasma-assisted CVD process to provide readiness in the feeding of source materials.

One embodiment of a method of forming the photoconductive layer 12 is described below with regard to a plasma-assisted CVD process.

According to this embodiment, to obtain by the plasma-assisted CVD process the photoconductive layer 12 formed of a-Si, first, a source gas for feeding silicon atoms and a source gas for feeding hydrogen atoms are each introduced in the gaseous state into a reactor, the interior of which can be evacuated. In one version, the source gas for feeding silicon atoms and the source gas for feeding hydrogen atoms may be of the same type. Then, glow discharge may be caused to take place in the reactor to decompose the source gases introduced thereinto, whereby the photoconductive layer 12 may be formed on the conductive substrate 13, which is maintained at a predetermined position.

In one version, as the source gas for feeding silicon atoms, silanes such as for example at least one of silane ($SiH_4$) and disilane ($Si_2H_6$) may be provided.

In another version, as the source gas for feeding hydrogen atoms, hydrogen gas ($H_2$) may also be used, for example in addition to the above silanes.

In the version where the photoconductive layer 12 further comprises any of the above atoms such as halogen atoms, atoms for controlling conductivity, carbon atoms, oxygen atoms and nitrogen atoms incorporated therein, gases or readily gasifiable substances containing the respective atoms may be used as source materials. For example, where the photoconductive layer further comprises carbon atoms incorporated therein, methane ($CH_4$) or the like may be used, and, where it further comprises boron atoms incorporated therein, diborane ($B_2H_6$) or the like may be used.

Substrate:

In one embodiment, the make-up of the substrate 13 (i.e., conductive substrate) may not be particularly limited, for example as long as it has conductivity and can hold the photoconductive layer 12 and surface layer 11 to be formed thereon. For example, the substrate may include those made of metals such as aluminum, chromium, molybdenum, indium, niobium, tellurium, vanadium, titanium, platinum, palladium and iron, and alloys of any of these, as exemplified by an aluminum alloy and stainless steel. Also usable as the conductive substrate may be films or sheets of synthetic resins, such as for example as least one of polyester, polyethylene, polycarbonate, cellulose acetate, polypropylene, polyvinyl chloride, polystyrene and polyamide, or an electrically insulating support made of glass or ceramic and having at least one surface on the side where the photoconductive layer is to be formed that has been subjected to conductive treatment.

Figure 2:
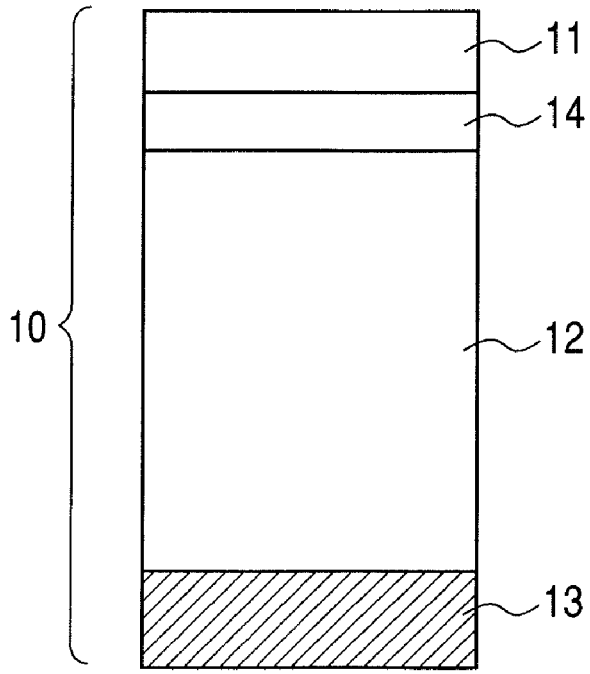
FIG. 2 is a diagrammatic view showing another example of a layer make-up of the electrophotographic photosensitive member of the present invention.

FIG. 2 is a diagrammatic view showing another example of the layer make-up of an embodiment of the electrophotographic photosensitive member in accordance with the present invention. The embodiment of the electrophotographic photosensitive member 10 shown in FIG. 2 has a cylindrical and conductive substrate 13, a photoconductive layer 12 formed on the substrate 13, an intermediate layer 14 formed on the photoconductive layer 12 and a surface layer 11 formed on the intermediate layer 14.

With regard to the substrate 13, the photoconductive layer 12 and the surface layer 11, these are the same as those of the electrophotographic photosensitive member shown in FIG. 1. Accordingly, only the make-up of the intermediate layer 14 is described below.

Intermediate Layer:

In the embodiment as shown in FIG. 2, an intermediate layer formed of an amorphous material comprising chiefly (i.e., primarily) silicon atoms and nitrogen atoms (a-SiN), or an amorphous material comprising chiefly (i.e., primarily) silicon atoms and carbon atoms (a-SiC), may be provided between the photoconductive layer 12 and the surface layer 11.

In one version, providing the intermediate layer 14 may enable improvement in photosensitivity.

In a case where it is intended that the surface layer 11 formed of AlNO is to be directly provided on the photoconductive layer 12 formed of a-Si, a diffusion layer in which the constituent elements of the photoconductive layer 12 and those of the surface layer 11 are mixed with each other at the interface between these layers may be formed, depending on conditions. If such a diffusion layer is formed, a region that causes some absorption of light may be created at a part of the layer, which may in some cases result in a lowering of photosensitivity.

According to an embodiment of the invention, the intermediate layer 14 may have the effect of inhibiting and even preventing the formation of such a diffusion layer, to keep the photosensitivity from being reduced. While the reason for this effect is unclear at the present time, it is believed that the a-SiN and the a-SiC may be more chemically stable than the a-Si that forms the photoconductive layer 12, and it is further believed that this stability may keep the components from diffusing with each other.

In one embodiment, in order to obtain the above effect sufficiently, the compositional ratio in the intermediate layer 14 may be controlled. For example, in the case where the a-SiN is employed as the material for forming the intermediate layer 14, the content of nitrogen atoms may be controlled within the range of from 10 atom % or more to 55 atom % or less based on the silicon atoms (i.e., relative to the number of silicon atoms), as stated previously. In one version, the content of silicon atoms and nitrogen atoms in the intermediate layer is from 50 atom % or more to 100 atom % or less in total, such as from 60 atom % or more to 90 atom % or less in total, and even from 70 atom % or more to 80 atom % or less in total, based on the sum of all the atoms in the intermediate layer (i.e., relative to the total number of atoms in the intermediate layer).

As another example, in the case where the a-SiC is employed as the material for forming the intermediate layer 14, the content of carbon atoms may be controlled within the range of from 10 atom % or more to 100 atom % or less based on the silicon atoms, as stated previously. In one version, the content of silicon atoms and carbon atoms in the intermediate layer is from 50 atom % or more to 100 atom % or less in total, such as from 60 atom % or more to 90 atom % or less in total, and even from 70 atom % or more to 80 atom % or less in total, based on the sum of all the atoms in the intermediate layer (i.e., relative to the total number of atoms in the intermediate layer).

In one version, the intermediate layer 14 may also comprise atoms for controlling conductivity incorporated therein. For example, as the atoms for controlling conductivity, the atoms that may be used may be the same as the above-described atoms for controlling conductivity that may be incorporated into the photoconductive layer 12.

A decrease in photosensitivity that may occur when the surface layer 11 is directly formed on the photoconductive layer 12 does not often affect the electrophotographic photosensitive member to the extent that it makes a difference in the serviceability of the member.

However, in one embodiment, the using of the intermediate layer 14 so as to keep photosensitivity from decreasing may enable the achievement of the performance of an electrophotographic photosensitive member having a higher tolerance under broader process conditions, and may also secure the advantage that the electrophotographic photosensitive member is adaptable to high-speed image forming conditions that may be used in the future.

A method for forming the intermediate layer 14, as in the case of the photoconductive layer 12, may comprise a deposited film forming method such as for example one or more of a plasma-assisted CVD process, a vacuum deposition process, a sputtering process and an ion plating process. In one version, the forming method is a plasma-assisted CVD process, for example to provide continuity after the formation of the photoconductive layer 12 and readiness in feeding source materials.

An embodiment of a method of forming the intermediate layer 14 by plasma-assisted CVD may be the same as the method of forming the photoconductive layer 12 by plasma-assisted CVD as described above.

In one embodiment, in addition to the layers described above, a lower-part charge injection blocking layer may be provided beneath the photoconductive layer 12, and an upper-part charge injection blocking layer may also be provided above the photoconductive layer 12.

In one version, the lower-part charge injection blocking layer and the upper-part charge injection blocking layer may each be formed using as a base the material that makes up the photoconductive layer 12.

For example, one or more of the lower-part charge injection blocking layer and the upper-part charge injection blocking layer may be formed as a layer having as a base an a-Si material, the unbonded arms of which have been terminated with hydrogen atoms or halogen atoms, and having incorporated therein a dopant such as at least one of a Group 13 element and a Group 15 element. This may enable use of a layer the conductivity type of which has been controlled, and which has been made to have the ability to block the injection of carriers.

In one version, the lower-part charge injection blocking layer may also optionally have incorporated therein at least one kind of atoms selected from carbon atoms, nitrogen atoms and oxygen atoms. This may enable control of stress such that this blocking layer also is capable of improving adhesion of the photoconductive layer 12 to the substrate.

In another version, the intermediate layer 14 may also have incorporated therein a substance for controlling conductivity, so as to be provided with the injection blocking function, and such a layer may be made to serve as the upper-part charge injection blocking layer.

These layers may be formed in accordance with the performance suitable for the electrophotographic photosensitive member.

Figure 3:
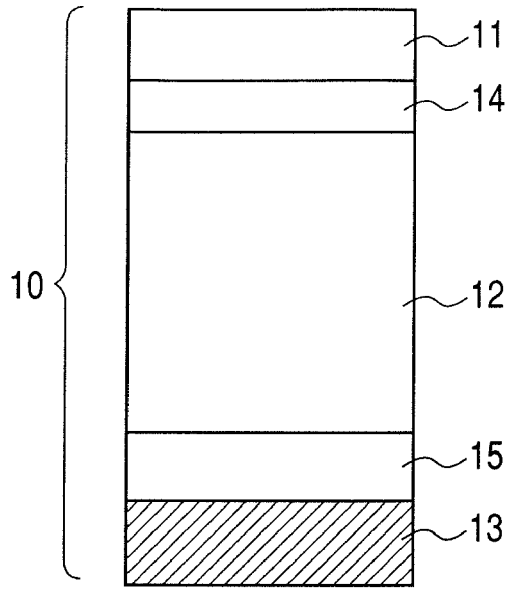
FIG. 3 is a diagrammatic view showing an example of a layer make-up of an electrophotographic photosensitive member where a lower-part charge injection blocking layer is formed.

FIG. 3 is a diagrammatic view showing an example of layer make-up of an embodiment of the electrophotographic photosensitive member where the lower-part charge injection blocking layer is formed. The embodiment of the electrophotographic photosensitive member 10 shown in FIG. 3 has a cylindrical and conductive substrate 13 formed of aluminum or the like, a lower-part charge injection blocking layer 15 formed on the substrate 13, a photoconductive layer 12 formed on the lower-part charge injection blocking layer 15, an intermediate layer 14 formed on the photoconductive layer 12 and a surface layer 11 formed on the intermediate layer 14.

An embodiment of a procedure of forming the photoconductive layer of the electrophotographic photosensitive member in accordance with the present invention is described next in detail, taking as an example a case in which the layer is formed by using an apparatus for forming deposited films by a plasma-assisted CVD process.

Figure 4:
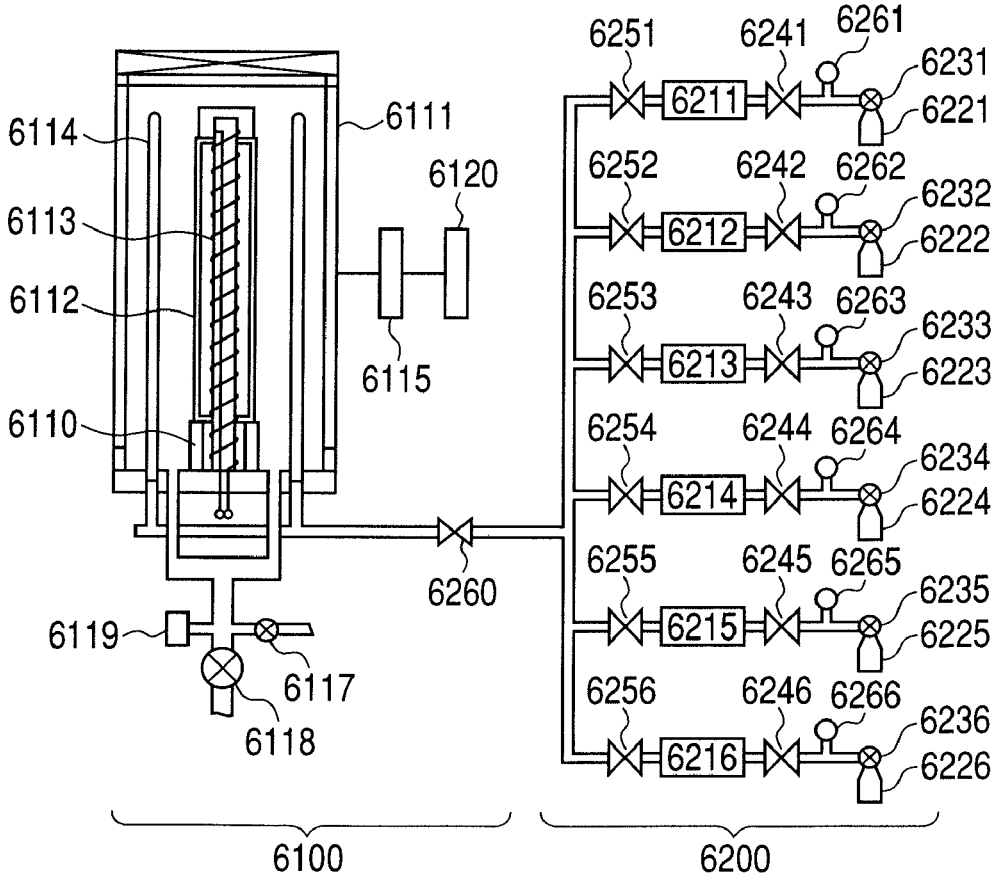
FIG. 4 is a diagrammatic view showing an example of a configuration of an apparatus for forming deposited films by high-frequency plasma-assisted CVD making use of RF bands as power source frequency.

FIG. 4 is a diagrammatic view showing an example of a configuration of an apparatus for forming deposited films by high-frequency plasma-assisted CVD, making use of RF bands as power source frequency.

This embodiment of the deposited film forming apparatus primarily comprises a deposition system 6100, a source gas feed system 6200 and an exhaust system (not shown) for evacuating the interior of a reactor 6111. The reactor 6111 in the deposition system 6100 is provided therein with a stand 6110 for setting thereon a cylindrical substrate 6112, a heater 6113 for heating the substrate, and a source gas feed pipe 6114. A high-frequency power source 6120 is also connected to a cathode serving also as the reactor 6111 (e.g., the reactor wall), through a high-frequency matching box 6115.

The reactor 6111 is connected to an exhaust system (not shown) through an exhaust valve 6118, and is set such that it is able to be evacuated. Reference numeral 6117 denotes a leak valve; and 6119, a vacuum gauge.

The source gas feed system 6200 comprises gas cylinders 6221 to 6226 for source gases, valves 6231 to 6236, 6241 to 6246 and 6251 to 6256, and mass flow controllers 6211 to 6216. The gas cylinders for the respective source gases are connected to the gas feed pipe 6114 in the reactor 6111 through a valve 6260. Reference numerals 6261 to 6266 denote regulators.

Using this embodiment of the deposited film forming apparatus, deposited films of the photoconductive layer may be formed, e.g., in the following way.

First, the cylindrical substrate 6112 is set in the reactor 6111, and the interior of the reactor 6111 is evacuated by means of an exhaust device (not shown) such as a vacuum pump. Subsequently, the temperature of the cylindrical substrate 6112 is controlled at a predetermined temperature of from 200° C. to 350° C., by means of the heater 6113 for heating the substrate.

Next, source gases for forming the deposited film are fed into the reactor 6111 while controlling their flow rates by operating the source gas feed system 6200. Then, while watching the indication of the vacuum gauge 6119, the exhaust valve 6118 is operated to set the interior at a predetermined pressure.

After the film formation has been thus readied to start, each layer may be formed, for example, according to the following procedure.

At the time the pressure in the reactor has become stable, electric power set at a predetermined value by means of the high-frequency power source 6120 is supplied to the cathode through the high-frequency matching box 6115, to cause high-frequency glow discharge to take place. An RF band of 1 MHz to 30 MHz may be used as the frequency for the glow discharge.

The source gases fed into the reactor 6111 are decomposed by the discharge energy thus produced, so that a deposited film comprising chiefly silicon atoms is formed on the substrate 6112. After a deposited film with a predetermined thickness has been formed, the supply of high-frequency power is stopped, and the respective valves of the gas feed system are closed to stop gases from flowing into the reactor 6111, and thus the formation of the deposited film is completed.

The like operation may be repeated a plurality of times, whereby a photoconductive layer with a predetermined multilayer structure may be formed. In one version, in order to make the deposited films more uniform, it may also be effective to rotate the cylindrical substrate 6112 at a predetermined speed by means of a driving mechanism (not shown), while the deposited films are being formed. The above source gases and valve operation may also be changed according to various conditions for forming the respective layers.

After the formation of all deposited films has been completed, the leak valve 6117 is opened to return the internal pressure of the reactor 6111 to atmospheric pressure, where the cylindrical substrate 6112 with the deposited films is taken out.

An example of a procedure for forming the surface layer of an embodiment of the electrophotographic photosensitive member according to the present invention is described next, taking as an example a case in which the surface layer is formed by using an apparatus for forming deposited films by a sputtering process.

Figure 5:
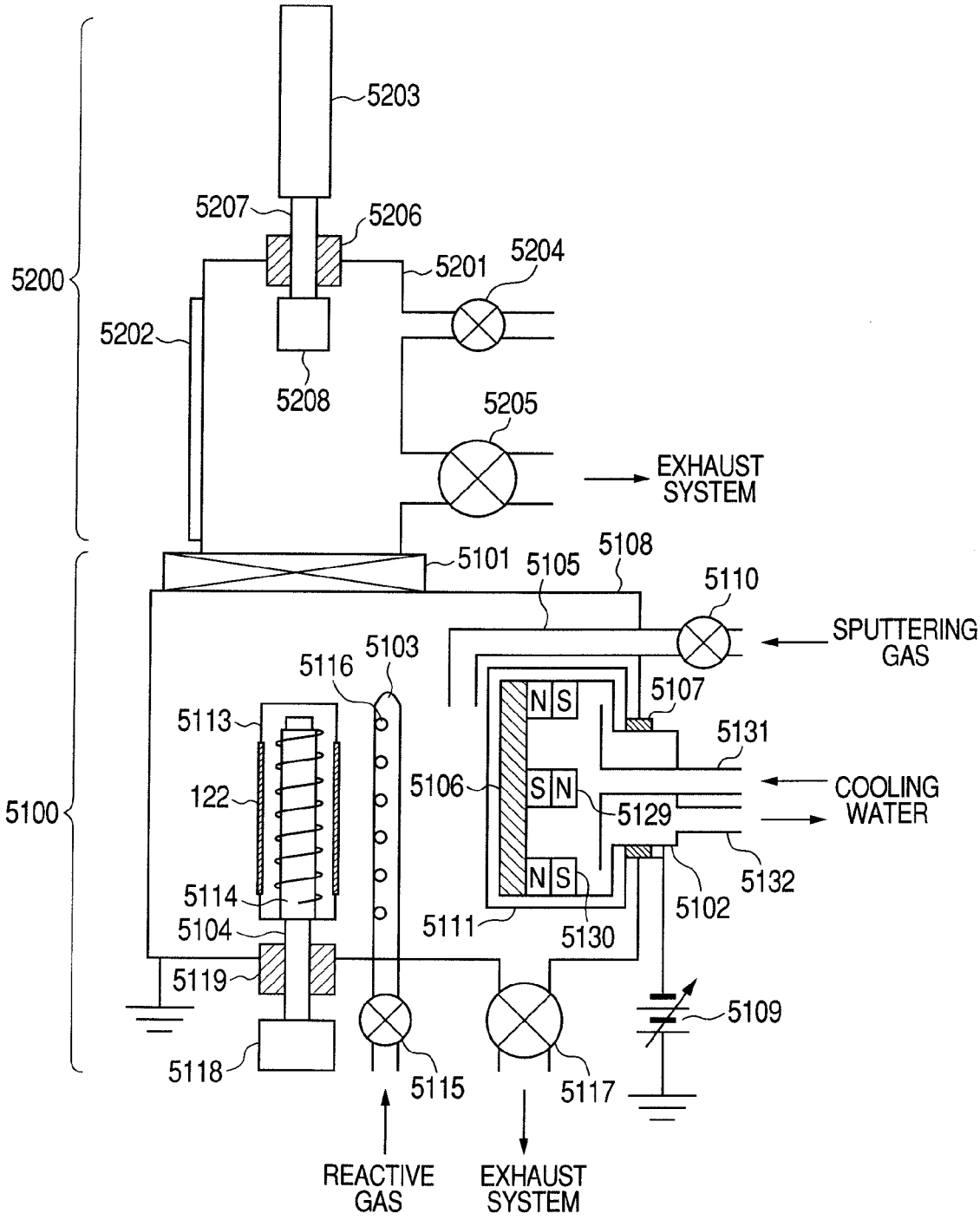
FIG. 5 is a diagrammatic view showing an example of a configuration of an apparatus for forming deposited films by sputtering making use of reactive gases.

FIG. 5 is a diagrammatic view showing an example of the configuration of an apparatus for forming deposited films by sputtering, making use of reactive gases.

This embodiment of the deposited film forming apparatus chiefly comprises a reaction furnace 5100 and a loading furnace 5200. The reaction furnace 5100 has a reactor 5108, a reactive-gas nozzle 5103, a rotating shaft 5104, a sputtering gas feed pipe 5105 and a cathode 5102.

The reactor 5108 is connected to an exhaust system (not shown) through a valve 5117, and is set such that it is able to be evacuated. A member 122 obtained by forming the photoconductive layer on the cylindrical substrate is set around the rotating shaft 5104 through means of a holder 5113. The rotating shaft 5104 is rotatably supported with a rotating shaft seal 5119, and is connected to a motor 5118 in the atmosphere. During the formation of a deposited film, the member 122 obtained by forming the photoconductive layer on the cylindrical substrate (hereinafter also simply "substrate member 122") is rotated by means of the motor 5118, and thus a uniform deposited film is formed on the substrate member 122 over its whole periphery.

The rotating shaft 5104 is provided on its outside with a heater 5114 which is so shaped as to be enclosed in the holder 5113, and thus the substrate member 122 can be heated to a predetermined temperature.

The reactive-gas nozzle 5103 has gas emission holes 5116, and is connected to a source gas feed system (not shown) through a valve 5115, so as to feed a reactive gas comprising, e.g., nitrogen gas ($N_2$), oxygen gas ($O_2$), and so forth. As the source gas feed system, a system may be used which is the same as the source gas feed system 6200 of the embodiment of the surface layer forming apparatus shown in FIG. 4.

The cathode 5102 is connected to the reactor 5108 through an insulating member 5107, and its peripheral surface is isolated from plasma with a shield 5111. The cathode 5102 is also set up such that it can be cooled from the outside through cooling water pipes 5131 and 5132 during the sputtering process.

The cathode 5102 is also connected to a power source 5109 on the outside of the reactor 5108. The cathode 5102 has a target 5106 comprising aluminum, and is further provided with magnets 5129 and 5130. The magnets 5129 and 5130 are set up such that their location can be controlled in accordance with the length of the substrate member 122, so as to enable formation of a film which is uniform in the normal direction of the substrate member 122.

The cathode 5102 is provided in the vicinity of a sputtering gas feed pipe 5105, which is connected to a sputtering gas feed system (not shown) through a valve 5110, and through which a sputtering gas such as argon gas (Ar) is fed.

The loading furnace 5200 consists chiefly of a vacuum chamber 5201, an actuator 5203 and a door 5202. The vacuum chamber 5201 communicates with the reactor 5108 by the aid of a gate valve 5101. The vacuum chamber 5201 is also set up such that its interior can be evacuated separately from the reactor 5108, by means of an exhaust system connected thereto through a valve 5205.

A shaft 5207 of the actuator 5203 is connected to the vacuum chamber 5201 by the aid of a vacuum seal 5206. The shaft 5207 is provided with a chucking mechanism 5208, which holds the substrate member 122 in vacuum, for example when the gate valve 5101 is opened and the shaft 5207 is stretched or retracted, and thus the substrate member 122 can be transported between the reaction furnace 5100 and the loading furnace 5200.

The vacuum chamber 5201 is also set up such that its interior can be vented through a valve 5204.

Using the embodiment of the deposited film forming apparatus shown in FIG. 5, a deposited film of the photoconductive layer may be formed, e.g., in the following way.

First, the valve 5117 is opened, and the interior of the reactor 5108 is kept evacuated by means of the exhaust system. At the same time, the substrate member 122 (e.g., member 122 obtained by forming the photoconductive layer on the substrate) is loaded into the loading furnace 5200, keeping the door 5202 open, and is positioned on the chucking mechanism 5208. Next, the door 5202 is closed and then the valve 5205 is opened, where the interior of the loading furnace 5200 is evacuated.

At the time both the interiors of the reactor 5108 and loading furnace 5200 have come to have a degree of vacuum of, e.g., 0.1 Pa or less, the gate valve 5101 is opened, and the actuator 5203 is operated to stretch the shaft 5207. Next, in order to position the substrate member 122 on the holder 5113 in the reactor 5108, the chucking mechanism 5208 is released to set the substrate member 122 on the holder 5113.

Thereafter, the shaft 5207 is retracted to return the chucking mechanism 5208 back to the loading furnace 5200, after which the gate valve 5101 is closed.

In this state, the heater 5114 may optionally be electrified to heat the substrate member 122 to the predetermined temperature.

At the time the substrate member 122 has come to have the predetermined temperature, the valves 5110 and 5115 are opened, and the sputtering gas and the reactive gas are fed into the reactor 5108 from the sputtering gas feed system (not shown) and the source gas feed system (not shown), respectively. Next, a vacuum gauge (not shown) connected to the reactor 5108 is checked to make sure that its interior has come to have a predetermined pressure, and electric power is supplied to the cathode 5102 from its power source to cause glow discharge to take place.

At this stage, the rotating shaft 5104 may be rotated by means of the motor 5118, and thus a deposited film can be formed uniformly in the peripheral direction (e.g., about the periphery) of the substrate member 122.

Once the deposited film has been formed, the supply of electric power from the power source 5109 is stopped to complete the formation thereof.

In one version, in order to form a surface layer comprising a plurality of regions, conditions for the gas, pressure, substrate temperature and so forth may be set anew, and thereafter the electric power may again be supplied to the cathode 5102 to cause the glow discharge to take place.

At the same time that the valves 5110 and 5115 are closed to finish the feeding of the sputtering gas and reactive gas, the electricity being delivered to the heater 5114 is stopped, and the interior of the reactor 5108 is first evacuated until it comes to have a pressure of, e.g., 0.1 Pa or less, and then the gate valve 5101 is opened.

Here, the actuator 5203 is operated to stretch the shaft 5207 to hold, by means of the chucking mechanism 5208, the substrate member 122 on which the surface layer has been formed. Thereafter, the shaft 5207 is again retracted to transport the substrate member 122 to the loading furnace 5200, after which the gate valve 5101 is closed.

After it has been verified that the gate valve 5101 has been closed, the valve 5204 is opened to vent the interior of the vacuum chamber 5201, and then the door 5202 is opened, after which the substrate member 122 on which the surface layer has been formed is taken out of the chamber to provide the electrophotographic photosensitive member.

In the foregoing description of the exemplary embodiments, the member 122 obtained by forming the photoconductive layer on the substrate, using the apparatus for forming deposited films by plasma-assisted CVD as shown in FIG. 4, is first taken out to the atmosphere and thereafter loaded into the apparatus for forming deposited films by sputtering as shown in FIG. 5. However, procedures in accordance with the present invention are not particularly limited to only such embodiments. For example, a transport system that can provide vacuum transport connecting both of the apparatuses may be installed between them, so that the member obtained by forming the photoconductive layer on the substrate can be moved from the former apparatus to the latter apparatus in vacuum.

Embodiments of according to the present invention are described below in greater detail by giving Examples.

EXAMPLES 1 TO 3 & COMPARATIVE EXAMPLE 1

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce each electrophotographic photosensitive member.

The photoconductive layer 12 was formed by using the apparatus for forming deposited films by plasma-assisted CVD as shown in FIG. 4 and under the conditions shown in Table 1. Here, the frequency of the high-frequency power was set to 13.56 MHz.

TABLE 1

| Photoconductive layer | |
|---|---|
| Gas flow rates: | |
| $SiH_4$ [ml/min (normal)] | 100 |
| $B_2H_6$ (ppm) (based on $SiH_4$) | 2.5 |
| $CH_4$ [ml/min (normal)] | 5 |
| Pressure (Pa) | 50 |
| High-frequency power (W) | 600 |
| Substrate temperature (° C.) | 210 |
| Layer thickness (μm) | 28 |

The surface layer 11 was formed by using the apparatus for forming deposited films by sputtering as shown in FIG. 5, and was formed of AlNO.

In the present Examples and Comparative Example, aluminum was used as the target, nitrogen gas ($N_2$) and oxygen gas ($O_2$) as the reactive gas, and argon gas (Ar) as the sputtering gas. The flow rates of $N_2$ and $O_2$ were controlled so as to change the N-content and also keep the O-content substantially constant.

Conditions for forming the surface layer 11 are shown in Tables 2 and 3.

TABLE 2

| Surface layer | |
|---|---|
| Gas flow rates: | |
| Ar [ml/min (normal)] | 150 |
| $N_2$ [ml/min (normal)] | Table 3 |
| $O_2$ [ml/min (normal)] | Table 3 |
| Pressure (Pa) | 0.5 |
| High-frequency power (W) | 1,500 |
| Substrate temperature (° C.) | 25 |
| Layer thickness (μm) | 0.8 |

TABLE 3

| | Example 1 | Example 2 | Example 3 | Comp. Example 1 |
|---|---|---|---|---|
| $N_2$ [ml/min (normal)] | 55 | 65 | 110 | 50 |
| $O_2$ [ml/min (normal)] | 50 | 53 | 68 | 50 |
| N-content (atom %) | 81 | 86 | 91 | 76 |
| O-content (atom %) | 26 | 26 | 26 | 27 |

The N-content and O-content shown in Table 3 are those found in the following way: Each electrophotographic photosensitive member produced under the same conditions was cut in a size of 12 mm×12 mm to prepare a sample, and its surface in the range of 2 mm×2 mm was measured with an ESCA (electron spectroscopy for chemical analysis) instrument (trade name: Quantum 2000 Scanning ESCA; manufactured by ULVAC-PHI Inc.) after any influence of surface deposits was removed by sputtering carried out at 4 kV for 5 minutes, and each content based on aluminum atoms (i.e., relative to the number of aluminum atoms) was shown by atom %.

In the present Examples and Comparative Example, hydrogen (H) atoms and halogen (X) atoms are intentionally not used. Accordingly, these atoms are substantially not contained in the surface layer of the electrophotographic photosensitive member in each example.

The electrophotographic photosensitive members produced in this way were evaluated in the following way.

First, the electrophotographic photosensitive members produced were each set in a conversion machine of an electrophotographic apparatus for evaluation (a copying machine; trade name: iR6000; manufactured by CANON INC.).

This electrophotographic apparatus for evaluation is so set that a heater built in the electrophotographic photosensitive member is also switched off when the apparatus is switched off, and is one in which, when switched on to work, the heater is electrified simultaneously with the usual sequence of switching on to work, and is so controlled that the surface of the electrophotographic photosensitive member may be heated to about 45° C.

This electrophotographic apparatus for evaluation also has a cleaning roller member, the magnet roller of which has been exchanged for a urethane rubber sponge roller. The sponge roller is also so designed such that it may come into contact with the electrophotographic photosensitive member at a nip width of 5 mm, and is so configured such that it may be rotated at a peripheral-speed difference of 120% in the forward direction with respect to the rotation of the electrophotographic photosensitive member. Also, a laser for imagewise exposure of 405 nm in wavelength is used as an image exposure unit. That is, the image exposure light with which the electrophotographic photosensitive member is to be irradiated has a wavelength of 405 nm.

Chargeability:

First, the electrophotographic photosensitive members produced were each set in the above electrophotographic apparatus for evaluation (having its charging unit and developing unit), and, keeping the image exposure unit (the laser) in the OFF state, a high voltage of +6 kV was applied to the charging unit to effect corona charging. The surface potential (i.e., dark-area potential) of the electrophotographic photosensitive member standing here was measured with a surface potentiometer (trade name: Model 334; manufactured by TREK JAPAN Co., Ltd.) set at a position corresponding to the developing unit. The measured value thus found was determined to be the chargeability of the electrophotographic photosensitive member. Incidentally, while in the present Examples a corona charging unit is used as the charging unit, the electrophotographic photosensitive member of the present invention may also be used in an electrophotographic apparatus having a contact charging unit.

Photosensitivity:

The electrophotographic photosensitive members produced were each set in the above electrophotographic apparatus for evaluation, and the charging electric current to be applied to the charging unit was so adjusted such that the dark-area potential came to be 450 V at the position of the developing unit.

While this charging electric current was maintained, the electrophotographic photosensitive member was irradiated with image exposure light (laser light), and the intensity of the image exposure light (laser light) was so adjusted such that the surface potential (i.e., dark-area potential) of the electrophotographic photosensitive member came to be 50 V. The intensity of the image exposure light (laser light) at this point was regarded as the photosensitivity of the electrophotographic photosensitive member.

Residual Potential:

Like the evaluation of the photosensitivity, after the adjustment was made such that the dark-area potential came to be 450 V at the position of the developing unit of the electrophotographic photosensitive member, the electrophotographic photosensitive member was irradiated with image exposure light (laser light) with an intensity of 1.2 $\mu J/cm^2$, and its light-area potential was measured. The measured value thus found was determined to be the residual potential.

After the above evaluation, a testing chart in which 6-point hiragana (the Japanese cursive syllabary) letters were formed over the whole area was placed on an original glass plate of the electrophotographic apparatus, and a running test in which images were repeatedly formed on 500,000 sheets of A4-size paper was conducted in an environment of a temperature of 30° C. and a humidity of 80% RH.

After the running test was conducted, evaluation was made on scratches and smeared images in the following way.

Scratches:

After the above running test was conducted, halftone images were reproduced in the same environment as that in the running test to visually examine whether or not image defects due to scratches appeared on the images reproduced. Also, the electrophotographic photosensitive member was detached from the electrophotographic apparatus for evaluation to visually examine whether or not the surface of the electrophotographic photosensitive member stood scratched at its areas for image formation. These were judged according to the following criteria:

A: No scratches are seen on the surface of the electrophotographic photosensitive member.

B: Scratches are seen on the surface of the electrophotographic photosensitive member, but any image defects due to scratches do not appear on the images reproduced.

C: Image defects due to scratches appear on the images reproduced, but are very small and are slight.

D: Image defects due to scratches appear on the images reproduced, and there is a possibility of, e.g., the misreading of letters.

Smeared Images:

After the above running test was conducted, the electrophotographic apparatus was left to stand for 12 hours in the same environment as that in the running test and in the state it was switched off. Thereafter, the electrophotographic apparatus was switched on to work in accordance with the usual sequence.

Here, a gray scale chart (a chart in which image densities of 0% to 100% in pixel density at 1,200 dpi were linearly changed by 10 grades) was kept placed on the original glass plate, and images were reproduced immediately after the electrophotographic apparatus was set working.

At this point, the image density of gray scale images at their part of 0% in pixel density and the image density thereof at their part of 100% in pixel density were measured with a transmission densitometer (trade name: Gretag Macbeth D200-II; manufactured by Gretag Macbeth AG). Here, adjustment was previously so made that a difference between the image density at the part of 0% in pixel density and the image density at the part of 100% in pixel density was about 1.2.

Transmission densities at the respective grades of the gray scale images thus obtained were measured afresh, and, in respect of differences between i) the density that was found by linearly interpolating values between the image density at the part of 0% in pixel density and the image density at the part of 100% in pixel density in such a way that it was in 10 grades in total and ii) the density at each grade that was found by actually measuring the gray scale images, their absolute values were summed and the value found was evaluated as smeared images.

That is, in the smeared images, the smaller the numerical value is, the less the smeared images are, showing that images were obtained which had improved and even superior reproducibility of gradation.

The results of evaluation in Examples 1 to 3 and Comparative Example 1 are shown in Table 4.

TABLE 4

| | Example 1 | Example 2 | Example 3 | Comp. Example 1 |
|---|---|---|---|---|
| N-content (atom %) | 81 | 86 | 91 | 76 |
| O-content (atom %) | 26 | 26 | 26 | 27 |
| Chargeability | 1.04 | 1 | 1.05 | 0.96 |
| Photosensitivity | 1.06 | 1 | 0.98 | 1.3 |
| Residual potential | 1.23 | 1 | 0.96 | 0.96 |
| Scratches | A | A | A | A |
| Smeared images | 0.93 | 1 | 1.05 | 1.03 |

In Table 4 and the following, the values of chargeability, photosensitivity, residual potential and smeared images are shown using relative values found when the corresponding values in Example 2 are each assumed as 1 (1.00).

In the evaluation thereof, the chargeability is better as the numerical value increases, and thus good performance may be provided, for example, when the value is 0.90 or more. The photosensitivity is also better as the numerical value decreases, and thus good performance may be provided, for example, when the value is 1.10 or less, which may enable adaptation to a broad range of process conditions.

The residual potential is better as the numerical value decreases, and thus good performance may be provided, for example, when the value is 3.00 or less, which may enable adaptation to a broad range of process conditions.

As to the smeared images, for a value of 1.20 or less, good images may be obtainable which are rich in gradation and have almost no recognizable color non-uniformity even in full-color images.

Figure 6:
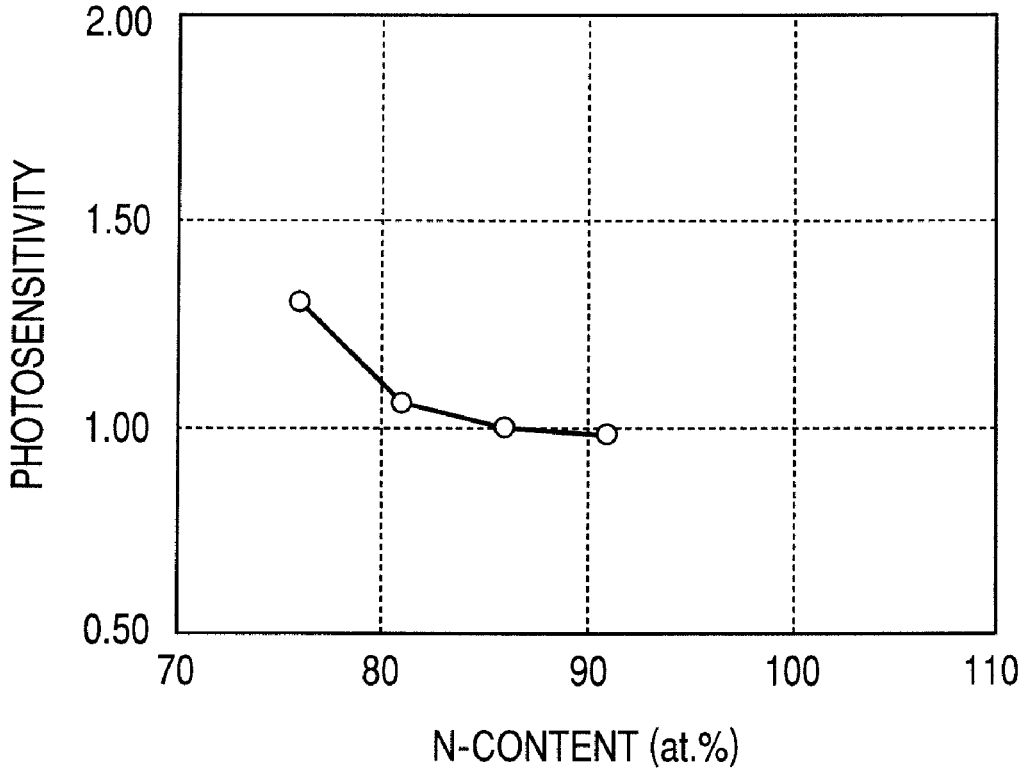
FIG. 6 is a graph showing the relationship between N-content and photosensitivity in Table 4.

The relationship between the N-content and the photosensitivity in Table 4 is shown in FIG. 6.

It can be seen from FIG. 6 that the N-content giving a photosensitivity of 1.10 or less is provided with a content of 80 atom % or more.

EXAMPLES 4 TO 6 & COMPARATIVE EXAMPLE 2

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce an electrophotographic photosensitive member. The photoconductive layer was formed under the same conditions as those in each of Examples 1 to 3.

The surface layer 11 was formed by using the apparatus for forming deposited films by sputtering as shown in FIG. 5, and was formed of AlNO.

In the present Examples and Comparative Example, aluminum was used as the target, nitrogen gas ($N_2$) and oxygen gas ($O_2$) as the reactive gas, and argon gas (Ar) as the sputtering gas. The flow rates of $N_2$ and $O_2$ were controlled so as to keep the O-content substantially constant while changing the N-content.

Conditions for forming the surface layer 11 are shown in Tables 5 and 6.

TABLE 5

| Surface layer | |
|---|---|
| Gas flow rates: | |
| Ar [ml/min (normal)] | 100 |
| $N_2$ [ml/min (normal)] | Table 6 |
| $O_2$ [ml/min (normal)] | Table 6 |
| Pressure (Pa) | 0.5 |
| High-frequency power (W) | 1,000 |
| Substrate temperature (° C.) | 25 |
| Layer thickness (μm) | 0.8 |

TABLE 6

| | Example 4 | Example 5 | Example 6 | Comp. Example 2 |
|---|---|---|---|---|
| $N_2$ [ml/min (normal)] | 75 | 80 | 93 | 127 |
| $O_2$ [ml/min (normal)] | 7 | 7 | 8 | 9 |
| N-content (atom %) | 87 | 91 | 95 | 98 |
| O-content (atom %) | 4.7 | 4.5 | 4.8 | 4.6 |

The content of each element based on the aluminum atoms (i.e., relative to the number of aluminum atoms) as shown in Table 6 was measured in the same way as in Examples 1 to 3.

In the present Examples and Comparative Example, hydrogen (H) atoms and halogen (X) atoms are intentionally not used. Accordingly, these atoms are substantially not contained in the surface layer of the electrophotographic photosensitive member in each example.

The electrophotographic photosensitive members produced in this way were evaluated in the same way as in Examples 1 to 3. The results of evaluation are shown in Table 7.

TABLE 7

| | Example 4 | Example 5 | Example 6 | Comp. Example 2 |
|---|---|---|---|---|
| N-content (atom %) | 87 | 91 | 95 | 98 |
| O-content (atom %) | 4.7 | 4.5 | 4.8 | 4.6 |
| Chargeability | 1.03 | 0.98 | 0.98 | 0.96 |
| Photosensitivity | 0.96 | 1.02 | 0.97 | 0.98 |
| Residual potential | 1.05 | 1.18 | 0.93 | 1 |
| Scratches | A | A | A | B |
| Smeared images | 1.03 | 0.92 | 0.98 | 1.03 |

In Table 7, the values of chargeability, photosensitivity, residual potential and smeared images are shown using relative values found when the corresponding values in Example 2 are each assumed as 1 (1.00).

It can be seen from Table 7 that a high durability (scratch resistance) against scratching may be achievable when the N-content is 95 atom % or less.

In Examples 1 to 3 and Comparative Example 1 and in Examples 4 to 6 and Comparative Example 2, the process conditions are different from each other. This is because, in the apparatus used in the experiments, it was found to be difficult to keep the O-content substantially constant while also changing the N-content within a predetermined range by changing only the flow rates of $N_2$ and $O_2$, for example in view of restrictions on gas feed ability, evacuation ability, discharge characteristics and so forth.

However, from the results in Examples 1 to 6 and Comparative Examples 1 and 2, it can be seen that electrophotographic photosensitive members having improved and even superior photosensitivity and scratch resistance are obtainable by controlling the N-content to be from 80 atom % or more to 95 atom % or less, while not relying on the O-content.

EXAMPLES 7 TO 9 & COMPARATIVE EXAMPLE 3

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce an electrophotographic photosensitive member. The photoconductive layer was formed under the same conditions as those in each of Examples 1 to 3.

The surface layer 11 was formed by using the apparatus for forming deposited films by sputtering as shown in FIG. 5, and was formed of AlNO.

In the present Examples and Comparative Example, aluminum was used as the target, nitrogen gas ($N_2$) and oxygen gas ($O_2$) as the reactive gas, and argon gas (Ar) as the sputtering gas. The flow rates of $N_2$ and $O_2$ were controlled to change the O-content while keeping the N-content substantially constant.

Conditions for forming the surface layer 11 are shown in Tables 8 and 9.

TABLE 8

| Surface layer | |
|---|---|
| Gas flow rates: | |
| Ar [ml/min (normal)] | 100 |
| $N_2$ [ml/min (normal)] | Table 9 |
| $O_2$ [ml/min (normal)] | Table 9 |
| Pressure (Pa) | 0.8 |
| High-frequency power (W) | 2,500 |
| Substrate temperature (° C.) | 25 |
| Layer thickness (μm) | 0.8 |

TABLE 9

| | Example 7 | Example 8 | Example 9 | Comp. Example 3 |
|---|---|---|---|---|
| $N_2$ [ml/min (normal)] | 140 | 145 | 150 | 140 |
| $O_2$ [ml/min (normal)] | 7 | 12 | 15 | 5 |
| N-content (atom %) | 93 | 92 | 93 | 93 |
| O-content (atom %) | 1.3 | 4.6 | 6.2 | 0.7 |

The content of each element based on the aluminum atoms (i.e., relative to the number of aluminum atoms) as shown in Table 9 was measured in the same way as in Examples 1 to 3.

In the present Examples and Comparative Example, hydrogen (H) atoms and halogen (X) atoms are intentionally not used. Accordingly, these atoms are substantially not contained in the surface layer of the electrophotographic photosensitive member in each example.

The electrophotographic photosensitive members produced in this way were evaluated in the same way as in Examples 1 to 3. The results of evaluation are shown in Table 10.

TABLE 10

| | Example 7 | Example 8 | Example 9 | Comp. Example 3 |
|---|---|---|---|---|
| N-content (atom %) | 93 | 92 | 93 | 93 |
| O-content (atom %) | 1.3 | 4.6 | 6.2 | 0.7 |
| Chargeability | 0.98 | 0.98 | 0.96 | 1.03 |
| Photosensitivity | 1.02 | 0.97 | 0.98 | 0.96 |
| Residual potential | 1.18 | 0.93 | 1 | 1.05 |
| Scratches | A | A | A | A |
| Smeared images | 1.08 | 0.98 | 1 | 1.32 |

In Table 10, the values of chargeability, photosensitivity, residual potential and smeared images are shown using relative values found when the corresponding values in Example 2 are each assumed as 1 (1.00).

Figure 7:
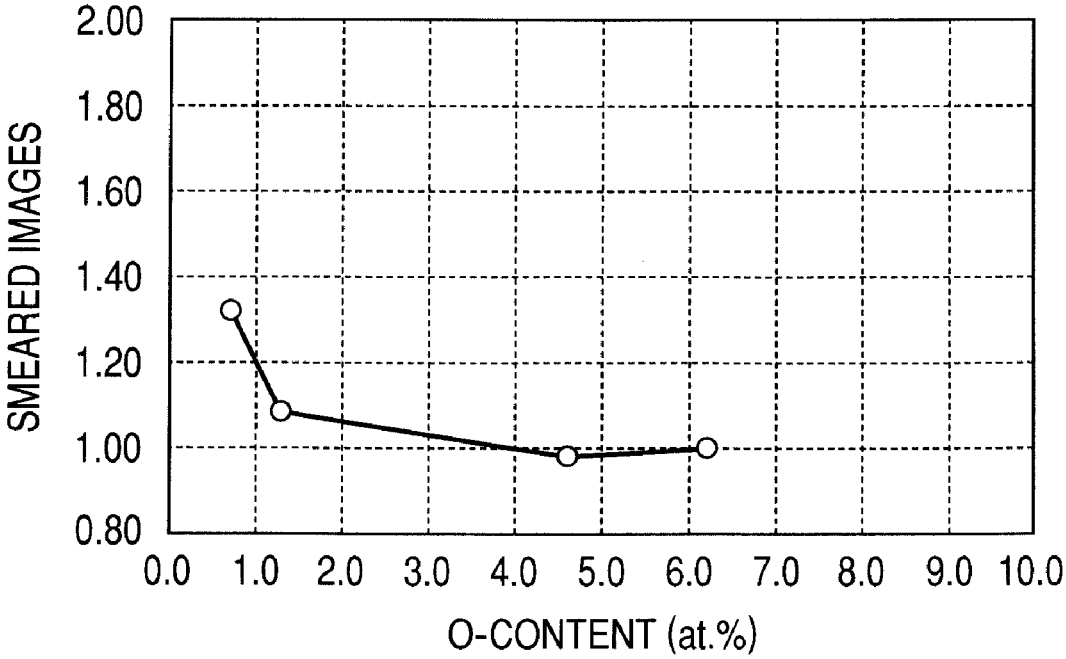
FIG. 7 is a graph showing the relationship between O-content and smeared images in Table 10.

The relationship between the O-content and the smeared images in Table 10 is shown in FIG. 7.

It can be seen from FIG. 7 that the O-content giving a value of smeared images of 1.20 or less is a content of 1.0 atom % or more.

EXAMPLES 10 TO 12 & COMPARATIVE EXAMPLE 4

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce an electrophotographic photosensitive member. The photoconductive layer was formed under the same conditions as those in each of Examples 1 to 3.

The surface layer 11 was formed by using the apparatus for forming deposited films by sputtering as shown in FIG. 5, and was formed of AlNO.

In the present Examples and Comparative Example, aluminum was used as the target, nitrogen gas ($N_2$) and oxygen gas ($O_2$) as the reactive gas, and argon gas (Ar) as the sputtering gas. The flow rates of $N_2$ and $O_2$ were controlled to change the O-content while keeping the N-content substantially constant.

Conditions for forming the surface layer 11 are shown in Tables 11 and 12.

TABLE 11

| Surface layer | |
|---|---|
| Gas flow rates: | |
| Ar [ml/min (normal)] | 100 |
| $N_2$ [ml/min (normal)] | Table 12 |
| $O_2$ [ml/min (normal)] | Table 12 |
| Pressure (Pa) | 0.5 |
| High-frequency power (W) | 1,000 |
| Substrate temperature (° C.) | 100 |
| Layer thickness (μm) | 0.5 |

TABLE 12

| | Example 10 | Example 11 | Example 12 | Comp. Example 4 |
|---|---|---|---|---|
| $N_2$ [ml/min (normal)] | 85 | 87 | 92 | 97 |
| $O_2$ [ml/min (normal)] | 10 | 13 | 23 | 35 |

TABLE 12-continued

| | Example 10 | Example 11 | Example 12 | Comp. Example 4 |
|---|---|---|---|---|
| N-content (atom %) | 85 | 84 | 85 | 83 |
| O-content (atom %) | 17 | 24 | 28 | 33 |

The content of each element based on the aluminum atoms as shown in Table 12 was measured in the same way as in Examples 1 to 3.

In the present Examples and Comparative Example, hydrogen (H) atoms and halogen (X) atoms are intentionally not used. Accordingly, these atoms are substantially not contained in the surface layer of the electrophotographic photosensitive member in each example.

The electrophotographic photosensitive members produced in this way were evaluated in the same way as in Examples 1 to 3. The results of evaluation are shown in Table 13.

TABLE 13

| | Example 10 | Example 11 | Example 12 | Comp. Example 4 |
|---|---|---|---|---|
| N-content (atom %) | 85 | 84 | 85 | 83 |
| O-content (atom %) | 17 | 24 | 28 | 33 |
| Chargeability | 0.97 | 1 | 1 | 0.97 |
| Photosensitivity | 1.04 | 1.07 | 0.97 | 1.03 |
| Residual potential | 0.93 | 1.2 | 1.13 | 0.96 |
| Scratches | A | A | A | A |
| Smeared images | 1.02 | 1.06 | 1.13 | 1.48 |

In Table 13, the values of chargeability, photosensitivity, residual potential and smeared images are shown using relative values found when the corresponding values in Example 2 are each assumed as 1 (1.00).

Figure 8:
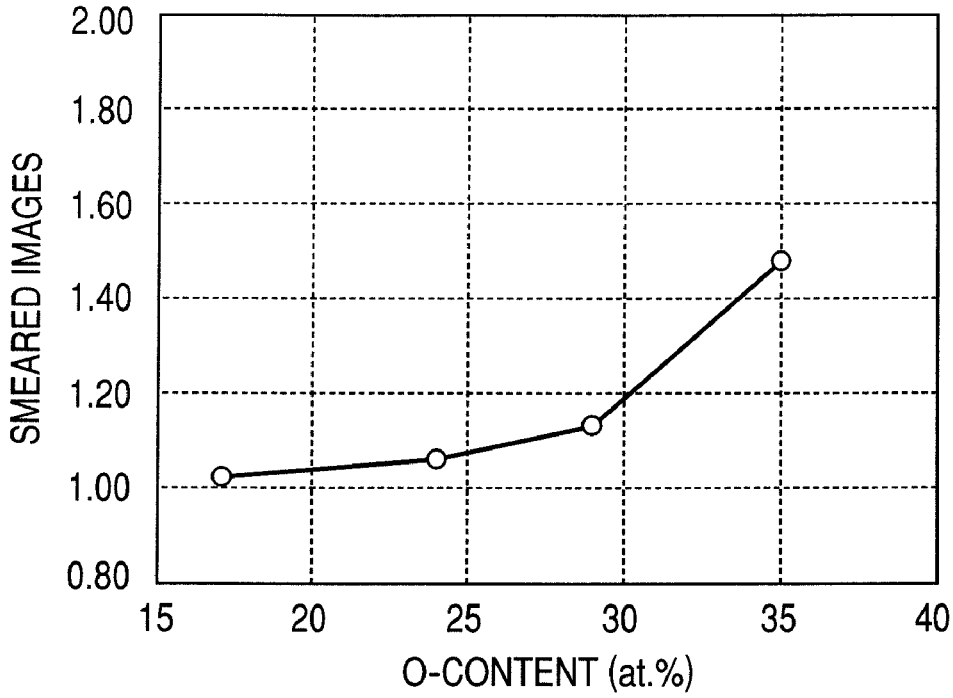
FIG. 8 is a graph showing the relationship between O-content and smeared images in Table 13.

The relationship between the O-content and the smeared images in Table 13 is shown in FIG. 8.

It can be seen from FIG. 8 that the O-content giving a value of smeared images of 1.20 or less is a content of 30 atom % or less.

In Examples 7 to 9 and Comparative Example 3 and in Examples 10 to 12 and Comparative Example 4, the process conditions are different from each other. This is because, in the apparatus used in experiments, it was found to be difficult to keep the N-content substantially constant while also changing the O-content within a predetermined range by changing only the flow rates of $N_2$ and $O_2$, for example in view of restrictions on gas feed ability, evacuation ability, discharge characteristics and so forth.

However, from the results in Examples 7 to 12 and Comparative Examples 3 and 4, it can be seen that good electrophotographic photosensitive members which do not readily cause smeared images may be obtainable by controlling the O-content to be from 1.0 atom % or more to 30 atom % or less, while not relying on the N-content.

EXAMPLES 13 TO 16

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce an electrophotographic photosensitive member. The photoconductive layer was formed under the same conditions as those in each of Examples 1 to 3.

The surface layer 11 was formed by using the apparatus for forming deposited films by sputtering as shown in FIG. 5, and was formed of AlNO.

In the present Examples, aluminum was used as the target, nitrogen gas ($N_2$) and oxygen gas ($O_2$) as the reactive gas, and argon gas (Ar) as the sputtering gas, and further hydrogen gas ($H_2$) was added to incorporate the AlNO with hydrogen (H) atoms. Here, the flow rates of $N_2$, $O_2$ and $H_2$ were controlled so as to keep the O-content and N-content substantially constant while changing the H-content.

Conditions for forming the surface layer 11 are shown in Tables 14 and 15.

TABLE 14

| Surface layer | |
|---|---|
| Gas flow rates: | |
| Ar [ml/min (normal)] | 100 |
| $N_2$ [ml/min (normal)] | Table 15 |
| $O_2$ [ml/min (normal)] | Table 15 |
| $H_2$ [ml/min (normal)] | Table 15 |
| Pressure (Pa) | 0.5 |
| High-frequency power (W) | 1,000 |
| Substrate temperature (° C.) | 100 |
| Layer thickness (μm) | 0.5 |

TABLE 15

| | Example 13 | Example 14 | Example 15 | Example 16 |
|---|---|---|---|---|
| $N_2$ [ml/min (normal)] | 85 | 85 | 85 | 85 |
| $O_2$ [ml/min (normal)] | 10 | 10 | 10 | 10 |
| $H_2$ [ml/min (normal)] | 0 | 5 | 12 | 25 |
| N-content (atom %) | 85 | 84 | 85 | 84 |
| O-content (atom %) | 10 | 11 | 11 | 10 |
| H-content (atom %) | 0 | 4.5 | 7.3 | 12 |
| X-content (atom %) | — | — | — | — |

The content of each element based on the aluminum atoms (i.e., relative to the number of aluminum atoms) as shown in Table 15 was measured in the same way as in Examples 1 to 3. As to the X-content, the total sum of the content of halogen atoms based on the aluminum atoms (i.e., relative to the number of aluminum atoms) was expressed by atom %. In actual measurement, a significant value of the X-content was not obtained, and hence it was considered that halogen atoms were substantially not contained therein. Accordingly, numerical values for the X-content are not shown in the table.

The H-content was measured on a sample prepared by forming a film of 0.5 μm in layer thickness on a glass sheet (trade name: 7059) available from Corning Glass Works, under the same conditions as those for the surface layer of each Example.

It was measured with a back scattering measuring instrument (trade name: AN-2500; manufactured by NHV Corporation) by hydrogen front analysis (HFS) to measure the H-content in the surface layer at its part of 0.4 μm in depth from the surface, and the H-content based on the aluminum atoms was calculated.

In regard to Example 13, a significant value for the H-content was not obtained, and hence it was considered that hydrogen atoms were substantially not contained therein. Accordingly, any numerical value is not shown in the table.

In the present Examples, the electrophotographic photosensitive members produced in this way were evaluated in the same way as in Examples 1 to 3. Further, the above running test was additionally conducted to form images further on 500,000 sheets (1,000,000 sheets in total), and thereafter evaluation was again made on the smeared images in the same way as the above.

The results of evaluation are shown in Table 16.

TABLE 16

| | Example 13 | Example 14 | Example 15 | Example 16 |
|---|---|---|---|---|
| N-content (atom %) | 85 | 84 | 85 | 84 |
| O-content (atom %) | 10 | 11 | 11 | 10 |
| H-content (atom %) | — | 4.5 | 7.3 | 12 |
| X-content (atom %) | — | — | — | — |
| Chargeability | 1.03 | 0.98 | 0.95 | 1 |
| Photosensitivity | 0.97 | 1.04 | 1.03 | 1.06 |
| Residual potential | 1.4 | 1.2 | 0.93 | 0.96 |
| Scratches | A | A | A | A |
| Smeared images After running tests, | | | | |
| 500,000 sheets: | 0.98 | 0.97 | 1.02 | 1.03 |
| 1,000,000 sheets: | 1.01 | 1.05 | 1.14 | 1.16 |

In Table 16, the values of chargeability, photosensitivity, residual potential and smeared images (both after the 500,000 sheet running and after the 1,000,000 sheet running) are shown using relative values found when the corresponding values in Example 2 are each assumed as 1 (1.00).

As can be seen from the results shown in Table 16, all the electrophotographic photosensitive members showed good performance without readily causing the smeared images after the 500,000 sheet running test. Meanwhile, in regard to those after the 1,000,000 sheet running test, the electrophotographic photosensitive member of Example 13, the surface layer of which contained substantially no hydrogen (H) atoms, showed the smeared images at substantially the same level as those in the 500,000 sheet running test, whereas the other electrophotographic photosensitive members, the surface layers of which contained hydrogen (H) atoms, all showed a tendency toward an increase of smeared images. Furthermore, the tendency towards smeared images increased with an increase in the H-content.

Without being limited to any particular theory, this is presumed to be due to the fact that the combination of the material of the layer with hydrogen atoms gradually comes to deteriorate and become broken apart with repetition of image formation over a long period of time, so that defects or imperfections come about, and this causes the smeared images.

Incidentally, in each of the present Examples, the surface layer 11 was formed by sputtering, and hence the H-content was controlled by adding $H_2$ in addition to $N_2$ and $O_2$, after which the effect of the H-content in the smeared images was inspected. The like results are presumed to be obtainable also in other film forming processes.

EXAMPLES 17 TO 20

Using as the conductive substrate 13 a cylinder of 80 mm in diameter, 358 mm in length and 3 mm in wall thickness, which was made of aluminum and the surface of which was mirror-finished, the photoconductive layer 12 and the surface layer 11 were formed in this order to produce an electrophotographic photosensitive member. The photoconductive layer was formed under the same conditions as those in each of Examples 1 to 3.

The surface layer 11 was formed by using the apparatus for forming deposited films by sputtering as shown in FIG. 5, and was formed of AlNO.

In the present Examples, aluminum was used as the target, nitrogen gas ($N_2$) and oxygen gas ($O_2$) as the reactive gas, and argon gas (Ar) as the sputtering gas, and further fluorine gas ($F_2$) was added to incorporate the AlNO with fluorine atoms (a kind of halogen atom). Here, the flow rates of $N_2$, $O_2$ and $F_2$ were controlled so as to keep the O-content and N-content substantially constant, while changing the content of fluorine atoms (hereinafter also "F-content") based on the aluminum atoms (i.e., relative to the number of aluminum atoms).

Conditions for forming the surface layer 11 are shown in Tables 17 and 18.

TABLE 17

| Surface layer | |
|---|---|
| Gas flow rates: | |
| Ar [ml/min(normal)] | 100 |
| $N_2$ [ml/min(normal)] | Table 18 |
| $O_2$ [ml/min(normal)] | Table 18 |
| $F_2$ [ml/min(normal)] (diluted with Ar to 10%) | Table 18 |
| Pressure (Pa) | 0.5 |
| High-frequency power (W) | 1,000 |
| Substrate temperature (° C.) | 100 |
| Layer thickness (μm) | 0.5 |

Here, the flow rate of fluorine gas ($F_2$) shows an actual flow rate of fluorine gas ($F_2$) among gases diluted with argon gas (Ar) to 10%, and the fluorine gas ($F_2$) is added together with argon gas (Ar) that is fed in an amount nine times as large as the value indicated.

TABLE 18

| | Example 17 | Example 18 | Example 19 | Example 20 |
|---|---|---|---|---|
| $N_2$ [ml/min(normal)] | 85 | 85 | 85 | 85 |
| $O_2$ [ml/min(normal)] | 10 | 10 | 10 | 10 |
| $F_2$ [ml/min(normal)] | 0 | 5 | 10 | 16 |
| N-content (atom %) | 84 | 84 | 83 | 83 |
| O-content (atom %) | 11 | 11 | 10 | 10 |
| H-content (atom %) | — | — | — | — |
| X-content (atom %) | 0 | 4.5 | 8.6 | 13 |

The content of each element based on the aluminum atoms (i.e., relative to the number of aluminum atoms) as shown in Table 18 was measured in the same way as in Examples 1 to 3. As to the X-content, the total sum of the content of halogen atoms based on the aluminum atoms was expressed by atom %.

In actual measurement, a significant value was not obtained as to the content of halogen atoms other than fluorine (F) atoms, and hence the X-content and the F-content are values which are substantially the same as each other. A significant value was also not obtained for the H-content, and hence it was considered that substantially no hydrogen atoms were contained therein. Accordingly, the numerical values thereof are not shown in the table. Also, in regard to Example 17, a significant value was not obtained for the X-content, and hence it was considered that substantially no halogen atoms were contained therein. Accordingly, the numerical values thereof are not shown in the table.

In the present Examples, the electrophotographic photosensitive members produced in this way were evaluated in the same way as in Examples 1 to 3. Further, the above running test was additionally conducted to form images further on 500,000 sheets (1,000,000 sheets in total), and thereafter evaluation was again made on the smeared images in the same way as the above.

The results of evaluation are shown in Table 19.

TABLE 19

| | Example 17 | Example 18 | Example 19 | Example 20 |
|---|---|---|---|---|
| N-content (atom %) | 84 | 84 | 83 | 83 |
| O-content (atom %) | 11 | 11 | 10 | 10 |
| H-content (atom %) | — | — | — | — |
| X-content (atom %) | — | 4.5 | 8.6 | 13 |
| Chargeability | 0.95 | 1 | 0.93 | 0.97 |
| Photosensitivity | 1.05 | 0.96 | 0.95 | 0.97 |
| Residual potential | 1.07 | 0.96 | 1.03 | 1 |
| Scratches | A | A | A | A |
| Smeared images After running tests, | | | | |
| 500,000 sheets: | 1.01 | 0.98 | 0.99 | 1.03 |
| 1,000,000 sheets: | 0.99 | 1.05 | 1.09 | 1.15 |

In Table 19, the values of chargeability, photosensitivity, residual potential and smeared images (both after the 500,000 sheet running and after the 1,000,000 sheet running) are shown using relative values found when the corresponding values in Example 2 are each assumed as 1 (1.00).

As can be seen from the results shown in Table 19, all the electrophotographic photosensitive members showed good performance without readily causing smeared images after the 500,000 sheet running test. Meanwhile, in regard to those after the 1,000,000 sheet running test, the electrophotographic photosensitive member of Example 17, the surface layer of which contained substantially no halogen (X) atom, showed the smeared images at substantially the same level as those in the 500,000 sheet running test, whereas the other electrophotographic photosensitive members, the surface layers of which contained halogen (X) atoms, all showed a tendency toward an increase in smeared images. Further, the tendency toward smeared images increased with an increase in the X-content.

Without being limited to any particular theory, this is believed to be due to the fact that the combination of the material of the layer with halogen atoms gradually comes to deteriorate and become broken apart with repetition of image formation over a long period of time, so that defects or imperfections come about, and this causes the smeared images.

It can be seen from the results of Examples 13 to 20 that the fact that the hydrogen (H) atoms and the halogen (X) atoms are substantially not contained in the surface layer of the electrophotographic photosensitive member makes the smeared images less likely to occur even in image formation over a long period of time.

However, as far as the electrophotographic photosensitive members having the N-content and the O-content within the ranges of the present invention are concerned, even in those containing the hydrogen (H) atoms or the halogen (X) atoms in their surface layers, all can achieve good performance although they may somewhat show a tendency towards an increase in smeared images with an increase in the number of sheets of the image formation in the running test, thus the members are believed to be relatively effective against the smeared images.

EXAMPLES 21 TO 28

Using as the conductive substrate 13 a cylinder of 80 mm in diameter, 358 mm in length and 3 mm in wall thickness, which was made of aluminum and the surface of which was mirror-finished, the lower-part charge injection blocking layer 15, the photoconductive layer 12, the intermediate layer 14 and the surface layer 11 were formed in this order to produce an electrophotographic photosensitive member.

In the present Examples, a-SiN was employed as the intermediate layer 14, where the flow rate of nitrogen gas ($N_2$) was controlled to change the content of nitrogen (N) atoms (hereinafter also "Nt-content") based on the silicon (Si) atoms (i.e., relative to the number of silicon atoms) in the intermediate layer 14.

The photoconductive layer 12 and the intermediate layer 14 were formed by using the apparatus for forming deposited films by plasma-assisted CVD as shown in FIG. 4 and under conditions shown in Tables 20 and 21. Here, the frequency of the high-frequency power was set to 13.56 MHz.

TABLE 20

| | Lower-part charge injection blocking layer | Photo-conductive layer | Intermediate layer |
|---|---|---|---|
| Gas flow rates: | | | |
| $SiH_4$ [ml/min(normal)] | 150 | 200 | 50 |
| $H_2$ [ml/min(normal)] | 600 | 750 | 100 |
| $B_2H_6$ (ppm)(based on $SiH_4$) | 1,500 | 3 | — |
| NO [ml/min(normal)] | 10 | — | — |
| $N_2$ [ml/min(normal)] | — | — | Table 21 |
| Pressure (Pa) | 80 | 80 | 60 |
| High-frequency power (W) | 200 | 500 | 600 |
| Substrate temperature (° C.) | 270 | 250 | 240 |
| Layer thickness (μm) | 3 | 30 | 0.05 |

TABLE 21

| | Example | | | | | | |
|---|---|---|---|---|---|---|---|
| | 21 | 22 | 23 | 24 | 25 | 26 | 27 |
| $N_2$ [ml/min(normal)] | 10 | 14 | 50 | 130 | 250 | 320 | 400 |
| Nt-content (atom %) | 3.3 | 4.6 | 12 | 30 | 49 | 58 | 63 |

The Nt-content shown in Table 21 was measured on a deposited film of 1 μm in layer thickness which was formed under the same conditions as those for the intermediate layer of each electrophotographic photosensitive member on a glass sheet (trade name: 7059) available from Corning Glass Works, and was measured by ESCA in the same way as in Examples 1 to 3.

The surface layer 11 was formed by using the apparatus for forming deposited films by sputtering as shown in FIG. 5, and was formed of AlNO under the same conditions as those in Example 2.

In the present Examples, an electrophotographic photosensitive member was also produced in which the intermediate layer 14 was not formed between the photoconductive layer 12 and the surface layer 11, and this was designated as Example 28.

The electrophotographic photosensitive members produced in this way were evaluated in the same way as in Examples 1 to 3. The results of evaluation are shown in Table 22.

TABLE 22

| | Example | | | | | | | |
|---|---|---|---|---|---|---|---|---|
| | 21 | 22 | 23 | 24 | 25 | 26 | 27 | 28 |
| Nt-content (atom %) | 3.3 | 4.6 | 12 | 30 | 49 | 58 | 63 | — |
| N-content (atom %) | 86 | 86 | 87 | 87 | 86 | 85 | 87 | 87 |
| O-content (atom %) | 26 | 25 | 25 | 26 | 26 | 25 | 25 | 25 |
| Chargeability | 0.95 | 1 | 0.93 | 1 | 0.97 | 1.03 | 1.03 | 1.02 |
| Photo-sensitivity | 0.96 | 0.96 | 0.9 | 0.85 | 0.87 | 0.94 | 0.96 | 1.02 |
| Resid. potential | 1.07 | 1.01 | 0.98 | 1 | 1.06 | 0.95 | 1 | 0.95 |
| Scratches | A | A | A | A | A | A | A | A |
| Smeared images | 0.95 | 1 | 0.93 | 1 | 0.97 | 1.03 | 1.03 | 1 |

The N-content and C-content shown in Table 22 are those based on the aluminum atoms (i.e., relative to the number of aluminum atoms), and are found in the same way as in Examples 1 to 3. In Table 22, the values of chargeability, photosensitivity, residual potential and smeared images are also shown using relative values found when the corresponding values in Example 2 are each assumed as 1 (1.00).

As can be seen from Table 22, the electrophotographic photosensitive members each provided with the intermediate layer 14 (Examples 21 to 27) are seen to have been improved in photosensitivity with respect to the electrophotographic photosensitive member not provided with the intermediate layer 14 (Example 28).

Figure 9:
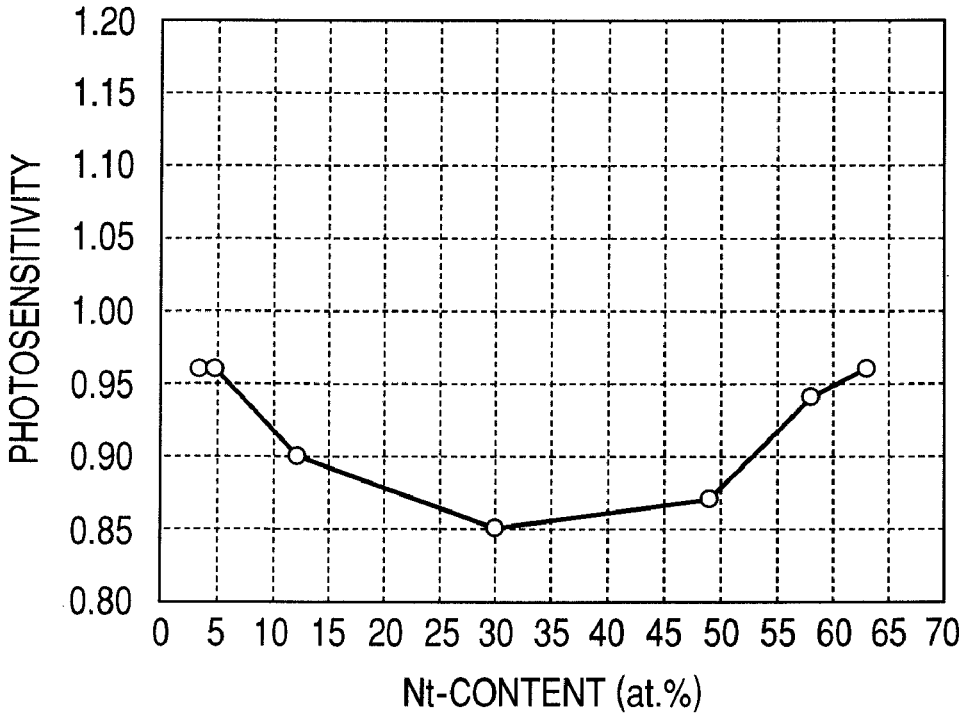
FIG. 9 is a graph showing the relationship between Nt-content and photosensitivity in Table 22.

The relationship between the Nt-content and the photosensitivity in Table 22 is shown in FIG. 9.

As long as the photosensitivity is 0.92 or less, a sufficient photosensitivity is considered to be achievable even where the electrophotographic apparatus is made high-speed by about 20%. According to what is shown in FIG. 9, it is seen that the photosensitivity is improved up to 0.92 or less to achieve good performance with an Nt-content that is within the range of from 10 atom % or more to 55 atom % or less.

EXAMPLES 29 TO 36

Using as the conductive substrate 13 a cylinder of 80 mm in diameter, 358 mm in length and 3 mm in wall thickness, which was made of aluminum and the surface of which was mirror-finished, the lower-part charge injection blocking layer 15, the photoconductive layer 12, the intermediate layer 14 and the surface layer 11 were formed in this order to produce an electrophotographic photosensitive member.

In the present Examples, a-SiC was employed as the intermediate layer 14, where the flow rate of methane gas ($CH_4$) was controlled to change the content of carbon (C) atoms (hereinafter also "C-content") based on the silicon (Si) atoms in the intermediate layer 14.

The photoconductive layer 12 and the intermediate layer 14 were formed by using the apparatus for forming deposited films by plasma-assisted CVD as shown in FIG. 4 and under conditions shown in Tables 23 and 24. Here, the frequency of the high-frequency power was set to 13.56 MHz.

TABLE 23

| | Lower-part charge injection blocking layer | Photo-conductive layer | Intermediate layer |
|---|---|---|---|
| Gas flow rates: | | | |
| $SiH_4$ [ml/min(normal)] | 150 | 200 | 50 |
| $H_2$ [ml/min(normal)] | 600 | 750 | 100 |
| $B_2H_6$ (ppm)(based on $SiH_4$) | 1,500 | 3 | — |
| NO [ml/min(normal)] | 10 | — | — |
| $CH_4$ [ml/min(normal)] | — | — | Table 24 |
| Pressure (Pa) | 80 | 80 | 60 |
| High-frequency power (W) | 200 | 500 | 600 |
| Substrate temperature (° C.) | 270 | 250 | 240 |
| Layer thickness (μm) | 3 | 30 | 0.05 |

TABLE 24

| | Example | | | | | | |
|---|---|---|---|---|---|---|---|
| | 29 | 30 | 31 | 32 | 33 | 34 | 35 |
| $CH_4$ [ml/min(normal)] | 10 | 14 | 50 | 130 | 280 | 400 | 600 |
| C-content (atom %) | 3.3 | 6.4 | 16 | 43 | 86 | 108 | 121 |

The C-content shown in Table 24 was measured on a deposited film of 1 μm in layer thickness which was formed under the same conditions as those for the intermediate layer of each electrophotographic photosensitive member on a glass sheet (trade name: 7059) available from Corning Glass Works, and was measured by ESCA in the same way as in Examples 1 to 3.

The surface layer 11 was formed by using the apparatus for forming deposited films by sputtering as shown in FIG. 5, and was formed of AlNO under the same conditions as those in Example 2.

In the present Examples, an electrophotographic photosensitive member was also produced in which the intermediate layer 14 was not formed between the photoconductive layer 12 and the surface layer 11, and this was designated as Example 36.

The electrophotographic photosensitive members produced in this way were evaluated in the same way as in Examples 1 to 3. The results of evaluation are shown in Table 25.

TABLE 25

| | Example | | | | | | | |
|---|---|---|---|---|---|---|---|---|
| | 29 | 30 | 31 | 32 | 33 | 34 | 35 | 36 |
| C-content (atom %) | 3.3 | 6.4 | 16 | 43 | 86 | 108 | 121 | — |
| N-content (atom %) | 86 | 86 | 86 | 86 | 87 | 86 | 87 | 87 |
| O-content (atom %) | 26 | 26 | 25 | 25 | 24 | 25 | 25 | 26 |
| Charge-ability | 0.95 | 0.96 | 0.96 | 1 | 1.03 | 1 | 1.03 | 1.02 |
| Photo-sensitivity | 0.95 | 0.94 | 0.89 | 0.87 | 0.88 | 0.94 | 0.96 | 1.02 |
| Resid. potential | 0.98 | 1 | 0.98 | 1 | 0.96 | 1.03 | 1 | 1 |
| Scratches | A | A | A | A | A | A | A | A |
| Smeared images | 1.03 | 1 | 0.96 | 1.03 | 1 | 1.03 | 1 | 0.96 |

The N-content and C-content shown in Table 25 are those based on the aluminum atoms (i.e., relative to the number of aluminum atoms), and are found in the same way as in Examples 1 to 3. In Table 25, the values of chargeability, photosensitivity, residual potential and smeared images are also shown using relative values found when the corresponding values in Example 2 are each assumed as 1 (1.00).

As can be seen from Table 25, the electrophotographic photosensitive members each provided with the intermediate layer 14 (Examples 29 to 35) are seen to have been improved in photosensitivity with respect to the electrophotographic photosensitive member not provided with the intermediate layer 14 (Example 36).

Figure 10:
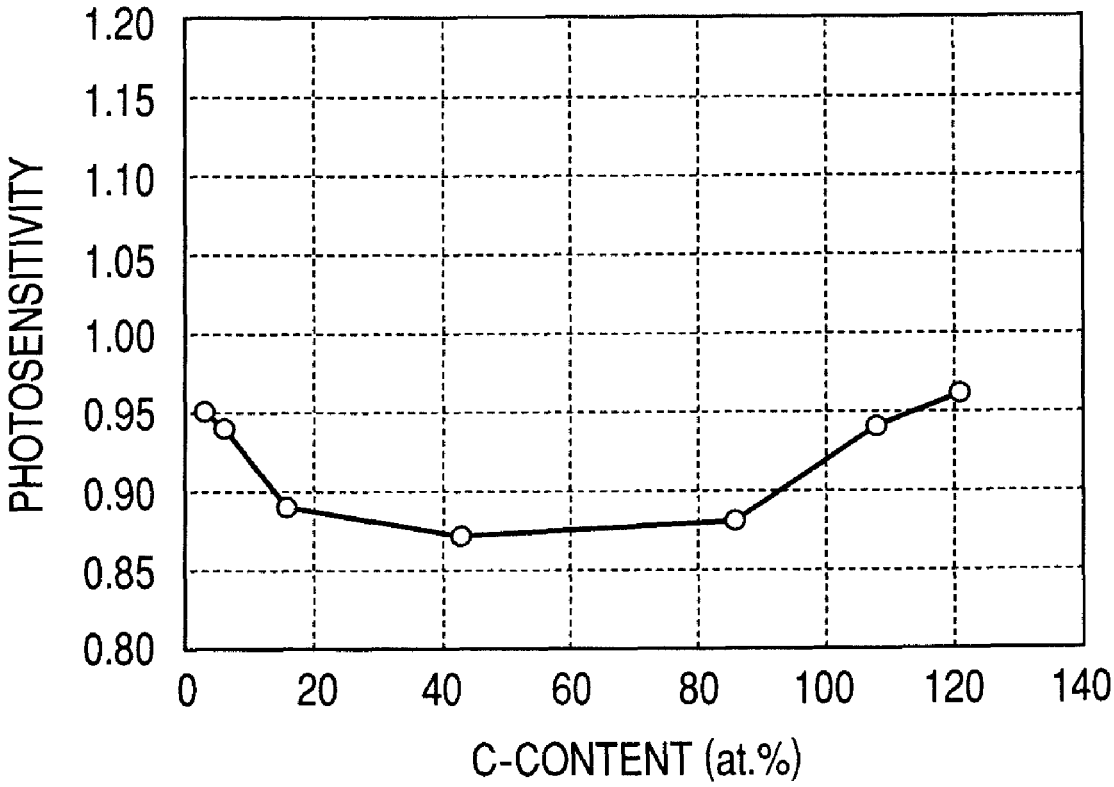
FIG. 10 is a graph showing the relationship between C-content and photosensitivity in Table 25.

The relationship between the C-content and the photosensitivity in Table 25 is shown in FIG. 10.

According to what is shown in FIG. 10, it is seen that the photosensitivity is improved up to 0.92 or less to achieve good performance, with a C-content that is within the range of from 10 atom % or more to 100 atom % or less.

COMPARATIVE EXAMPLE 5

Using as the conductive substrate 13 a cylinder of 80 mm in diameter, 358 mm in length and 3 mm in wall thickness, which was made of aluminum and the surface of which was mirror-finished, the photoconductive layer 12, the intermediate layer 14 and the surface layer 11 were formed in this order to produce an electrophotographic photosensitive member.

In the present Comparative Example, the photoconductive layer 12, the intermediate layer 14 and the surface layer 11 were formed by using the apparatus for forming deposited films by plasma-assisted CVD as shown in FIG. 4 and under conditions shown in Table 26. Here, the frequency of the high-frequency power was set to 13.56 MHz.

In other words, the electrophotographic photosensitive member of the present Comparative Example is one in which the lower-part charge injection blocking layer was not formed, and the surface layer of the electrophotographic photosensitive member of Example 32 was exchanged for a surface layer formed of a-SiN by plasma-assisted CVD.

TABLE 26

| | Photoconductive layer | Intermediate layer | Surface layer |
|---|---|---|---|
| Gas flow rates: | | | |
| $SiH_4$ [ml/min(normal)] | 200 | 50 | 30 |
| $H_2$ [ml/min(normal)] | 750 | 100 | 500 |
| $B_2H_6$ (ppm)(based on $SiH_4$) | 3 | — | — |
| $CH_4$ [ml/min(normal)] | — | 130 | 2 |
| $N_2$ [ml/min(normal)] | — | — | 350 |
| $CO_2$ [ml/min(normal)] | — | — | 2 |
| Pressure (Pa) | 80 | 60 | 50 |
| High-frequency power (W) | 500 | 600 | 400 |
| Substrate temperature (° C.) | 250 | 240 | 240 |
| Layer thickness (μm) | 30 | 0.05 | 0.8 |

About Comparative Example 5, a sample was also prepared in the same way as in Examples 1 to 3, and the content of nitrogen atoms based on the total sum of silicon atoms, carbon atoms and oxygen atoms (i.e., relative to the total number of silicon, carbon and oxygen atoms), the content of carbon atoms based on the total sum of silicon atoms, carbon atoms and oxygen atoms and the content of oxygen atoms based on the total sum of silicon atoms, carbon atoms and oxygen atoms were measured by ESCA. The content of hydrogen atoms based on silicon atoms (i.e., relative to the number of silicon atoms) was also measured by HFS in the same way as in Examples 13 to 16.

As the result, the content of nitrogen atoms based on the total sum of silicon atoms, carbon atoms and oxygen atoms was found to be 39 atom %, the content of carbon atoms based on the total sum of silicon atoms, carbon atoms and oxygen atoms was found to be 2.5 atom %, and the content of oxygen atoms based on the total sum of silicon atoms, carbon atoms and oxygen atoms was found to be 2.7 atom %. The content of hydrogen atoms based on silicon atoms was also found to be 11 atom %.

The electrophotographic photosensitive member produced in this way was evaluated in the same way as in Examples 1 to 3. The results of evaluation are shown in Table 27.

TABLE 27

| | Comparative Example 5 |
|---|---|
| Chargeability | 0.95 |
| Photosensitivity | 0.95 |
| Residual potential | 0.98 |
| Scratches | A |
| Smeared images | 1.33 |

In Table 27, the values of chargeability, photosensitivity, residual potential and smeared images are shown using relative values found when the corresponding values in Example 2 are each assumed as 1 (1.00).

As can be seen from the results shown in Table 27, the electrophotographic photosensitive member of Comparative Example 5 shows a performance against smeared images that is inferior to that of all the electrophotographic photosensitive members of Examples of the present invention. In particular, it is seen from the results of evaluation of the electrophotographic photosensitive member of Example 16 that the electrophotographic photosensitive member having the surface layer formed of AlNO according to an embodiment of the present invention is more effective against the smeared images even in comparison with that having substantially the same H-content based on the element having the largest content.

As has been described above, in the examples according to the present invention, an electrophotographic photosensitive member can be provided in which the defects or imperfections in the surface layer have effectively been compensated for, and also the occurrence of new defects or imperfections in the surface layer is reduced even where images are repeatedly reproduced over a long period of time, which members also having improved and even superior photosensitivity and scratch resistance.

As the result, in the examples according to the present invention, the electrophotographic photosensitive member can be provided that does not readily cause smeared images and can reproduce high-grade images over a long period of time, and an electrophotographic apparatus having such an electrophotographic photosensitive member can also be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-000456, filed Jan. 7, 2008, and Japanese Patent Application No. 2008-313399, filed Dec. 9, 2008, which are hereby incorporated by reference herein in their entirety.

What is claimed is:

1. An electrophotographic photosensitive member comprising:

a conductive substrate;

a photoconductive layer formed on the conductive substrate; and a surface layer formed on the photoconductive layer, wherein, the photoconductive layer is formed of an amorphous material comprising chiefly silicon atoms, the surface layer comprises chiefly aluminum atoms, nitrogen atoms and oxygen atoms, the nitrogen atoms in the surface layer are in a content of from 80 atom % to 95 atom % based on the aluminum atoms in the surface layer, and the oxygen atoms in the surface layer are in a content of from 1 atom % to 30 atom % based on the aluminum atoms in the surface layer.

2. The electrophotographic photosensitive member according to claim 1, wherein the surface layer comprises neither hydrogen atoms nor halogen atoms.

3. The electrophotographic photosensitive member according to claim 1, which comprises, between the photoconductive layer and the surface layer, an intermediate layer formed of an amorphous material comprising chiefly silicon atoms and nitrogen atoms, or an intermediate layer formed of an amorphous material comprising chiefly silicon atoms and carbon atoms.

4. An electrophotographic apparatus comprising:

an electrophotographic photosensitive member;

a charging unit;

an image exposure unit; and a developing unit, wherein the electrophotographic photosensitive member comprises:

a conductive substrate;

a photoconductive layer formed on the conductive substrate; and a surface layer formed on the photoconductive layer, wherein, the photoconductive layer is formed of an amorphous material comprising chiefly silicon atoms, the surface layer comprises chiefly aluminum atoms, nitrogen atoms and oxygen atoms, the nitrogen atoms in the surface layer are in a content of from 80 atom % to 95 atom % based on the aluminum atoms in the surface layer, and the oxygen atoms in the surface layer are in a content of from 1 atom % to 30 atom % based on the aluminum atoms in the surface layer.

5. The electrophotographic apparatus according to claim 4, wherein the surface layer comprises neither hydrogen atoms nor halogen atoms.

6. The electrophotographic apparatus according to claim 4, wherein the electrophotographic photosensitive member comprises, between the photoconductive layer and the surface layer, an intermediate layer formed of an amorphous material comprising chiefly silicon atoms and nitrogen atoms, or an intermediate layer formed of an amorphous material comprising chiefly silicon atoms and carbon atoms.

7. The electrophotographic apparatus according to claim 4, wherein the image exposure unit is a unit for irradiating the electrophotographic photosensitive member with image exposure light having a wavelength of from 380 nm to 500 nm.

8. The electrophotographic photosensitive member according to claim 1, wherein the electrophotographic photosensitive member comprises, between the photoconductive layer and the surface layer, a layer to inhibit a lowering of photosensitivity of the electrophotographic photosensitive member.

9. The electrophotographic photosensitive member according to claim 1, wherein the electrophotographic photosensitive member comprises a charge injection blocking layer above and/or beneath the photoconductive layer.

* * * * *